US006644052B1

(12) United States Patent
Wightman

(10) Patent No.: US 6,644,052 B1
(45) Date of Patent: Nov. 11, 2003

(54) VAPOR COMPRESSION SYSTEM AND METHOD

(75) Inventor: David A. Wightman, Prospect Heights, IL (US)

(73) Assignee: XDX, LLC, Wheeling, IL (US)

( * ) Notice: Subject to any disclaimer, the term of this patent is extended or adjusted under 35 U.S.C. 154(b) by 0 days.

(21) Appl. No.: 09/443,071

(22) Filed: Nov. 18, 1999

Related U.S. Application Data

(63) Continuation-in-part of application No. 09/228,696, filed on Jan. 12, 1999, now Pat. No. 6,314,747.

(51) Int. Cl.[7] ..... F25B 41/00
(52) U.S. Cl. ..... 62/196.4; 62/205; 62/222
(58) Field of Search ..... 62/204, 205, 206, 62/210, 211, 212, 222, 223, 224, 225, 196.4

(56) References Cited

U.S. PATENT DOCUMENTS

| | | | |
|---|---|---|---|
| 1,907,885 | A | 5/1933 | Shively |
| 2,084,755 | A | 6/1937 | Young, Jr. |
| 2,112,039 | A | 3/1938 | McLenegan |
| 2,126,364 | A | 8/1938 | Witzel |
| 2,164,761 | A | 7/1939 | Ashley |
| 2,200,118 | A | 5/1940 | Miller |
| 2,229,940 | A | 1/1941 | Spofford |
| 2,323,408 | A | 7/1943 | Miller |
| 2,467,519 | A | 4/1949 | Borghesan |
| 2,471,448 | A | 5/1949 | Platon |
| 2,511,565 | A | 6/1950 | Carter |
| 2,520,191 | A | 8/1950 | Aughey et al. |
| 2,539,062 | A | 1/1951 | Dillman |
| 2,547,070 | A | 4/1951 | Aughey et al. |
| 2,571,625 | A | 10/1951 | Seldon |
| 2,596,036 | A | 5/1952 | MacDougall |
| 2,707,868 | A | 5/1955 | Goodman |
| 2,755,025 | A | 7/1956 | Boles |
| 2,771,092 | A | 11/1956 | Schenk |

(List continued on next page.)

FOREIGN PATENT DOCUMENTS

| | | |
|---|---|---|
| DE | 197 52 259 A1 | 6/1998 |
| DE | 197 43 734 A1 | 4/1999 |

(List continued on next page.)

OTHER PUBLICATIONS

03304466; Hiroshi et al.; Air Conditioner; Nov. 15, 1990; Pub. No. 02–279966; p. 156.

02979575; Tadashi et al., Refrigerating Cycle; Nov. 7, 1989; Pub. No. 01–277175; p. 46.

(List continued on next page.)

*Primary Examiner*—Harry B. Tanner
(74) *Attorney, Agent, or Firm*—Brinks Hofer Gilson & Lione

(57) ABSTRACT

A vapor compression refrigeration and freezer system includes a compressor, a condenser, an expansion devise and an evaporator which includes an evaporator coil having an inlet and an outlet which coil is in heat exchange relation with an air medium along substantially the entire coil length. The inlet to the evaporator coil is in flow communication with an outlet of the expansion devise via an evaporator feedline. The expansion device can include a multifunctional valve that cooperates with the evaporator feedline to supply the evaporator coil inlet with a mixture of refrigerant vapor and liquid at a linear velocity and with relative amounts of vapor and liquid which are sufficient to provide efficient heat transfer along substantially the entire length of the coil, substantially reducing the build-up of frost on the evaporator coil and enabling the system to be operated without requiring a defrosting cycle over a substantially increased number of operating cycles compared to conventional refrigeration and freezer systems operating at the same cooling load and evaporating temperature conditions.

30 Claims, 20 Drawing Sheets

U.S. PATENT DOCUMENTS

| | | | | |
|---|---|---|---|---|
| 2,856,759 | A | 10/1958 | Barbulesco | |
| 2,922,292 | A | 1/1960 | Lange | |
| 2,944,411 | A | 7/1960 | McGrath | |
| 2,960,845 | A | 11/1960 | Lange | 62/205 |
| 3,007,681 | A | 11/1961 | Keller | |
| 3,014,351 | A | 12/1961 | Leimbach | |
| 3,060,699 | A | 10/1962 | Tilney | |
| 3,138,007 | A | 6/1964 | Friedman et al. | |
| 3,150,498 | A | 9/1964 | Blake | |
| 3,194,499 | A | 7/1965 | Noakes et al. | |
| 3,257,822 | A | 6/1966 | Abbott | |
| 3,316,731 | A | 5/1967 | Quick | |
| 3,343,375 | A | 9/1967 | Quick | |
| 3,392,542 | A | 7/1968 | Nussbaum | |
| 3,402,566 | A | 9/1968 | Leimbach | |
| 3,427,819 | A | 2/1969 | Seghetti | |
| 3,464,226 | A | 9/1969 | Kramer | |
| 3,520,147 | A | 7/1970 | Glackman | |
| 3,631,686 | A | 1/1972 | Kautz | |
| 3,633,378 | A | 1/1972 | Toth | |
| 3,638,444 | A | 2/1972 | Lindahl | |
| 3,638,447 | A | 2/1972 | Abe | |
| 3,683,637 | A | 8/1972 | Oshima et al. | |
| 3,708,998 | A | 1/1973 | Scherer et al. | |
| 3,727,423 | A | 4/1973 | Nielson | |
| 3,785,163 | A | 1/1974 | Wagner | |
| 3,792,594 | A | 2/1974 | Kramer | |
| 3,798,920 | A | 3/1974 | Morgan | |
| 3,822,562 | A | 7/1974 | Crosby | |
| 3,866,427 | A | 2/1975 | Rothmayer et al. | |
| 3,921,413 | A | 11/1975 | Kohlbeck | |
| 3,934,424 | A | 1/1976 | Goldsberry | |
| 3,934,426 | A | 1/1976 | Jespersen et al. | |
| 3,948,060 | A | 4/1976 | Gaspard | |
| 3,965,693 | A | 6/1976 | Widdowson | |
| 3,967,466 | A | 7/1976 | Edwards | |
| 3,967,782 | A | 7/1976 | Eschbaugh et al. | |
| 3,968,660 | A | 7/1976 | Amann et al. | |
| 3,980,129 | A | 9/1976 | Bergdahl | |
| 4,003,729 | A | 1/1977 | McGrath | |
| 4,003,798 | A | 1/1977 | McCord | |
| 4,006,601 | A | 2/1977 | Ballarin et al. | |
| 4,103,508 | A | 8/1978 | Apple | |
| 4,106,691 | A | 8/1978 | Nielsen | |
| 4,122,686 | A | 10/1978 | Lindahl et al. | |
| 4,122,688 | A | 10/1978 | Mochizuki et al. | |
| 4,136,528 | A | 1/1979 | Vogel et al. | |
| 4,151,722 | A | 5/1979 | Willitts et al. | |
| 4,163,373 | A | 8/1979 | van der Sluijs | |
| 4,167,102 | A | 9/1979 | Willitts | |
| 4,176,525 | A | 12/1979 | Tucker et al. | |
| 4,182,133 | A | 1/1980 | Haas et al. | |
| 4,184,341 | A | 1/1980 | Friedman | |
| 4,193,270 | A | 3/1980 | Scott | |
| 4,207,749 | A | 6/1980 | Lavigne, Jr. | |
| 4,230,470 | A | 10/1980 | Matsuda et al. | |
| 4,235,079 | A | 11/1980 | Masser | |
| 4,270,362 | A | 6/1981 | Lancia et al. | |
| 4,285,205 | A | 8/1981 | Martin et al. | |
| 4,290,480 | A | 9/1981 | Sulkowski | |
| 4,302,945 | A | 12/1981 | Bell | |
| 4,328,682 | A | 5/1982 | Vana | |
| 4,350,021 | A | 9/1982 | Lundstrom | |
| 4,398,396 | A | 8/1983 | Schmerzler | |
| 4,430,866 | A | 2/1984 | Willitts | |
| 4,451,273 | A | 5/1984 | Cheng et al. | |
| 4,485,642 | A | 12/1984 | Karns | |
| 4,493,364 | A | 1/1985 | Macriss et al. | |
| 4,543,802 | A | 10/1985 | Ingelmann et al. | |
| 4,583,582 | A | 4/1986 | Grossman | |
| 4,596,123 | A | 6/1986 | Cooperman | |
| 4,606,198 | A | 8/1986 | Latshaw et al. | |
| 4,621,505 | A | 11/1986 | Ares et al. | |
| 4,633,681 | A | 1/1987 | Webber | |
| 4,658,596 | A | 4/1987 | Kuwahara | |
| 4,660,385 | A | 4/1987 | Macriss et al. | |
| 4,742,694 | A | 5/1988 | Yamanaka et al. | |
| 4,779,425 | A | 10/1988 | Sasaki et al. | |
| 4,813,474 | A | 3/1989 | Umezu | |
| 4,848,100 | A | 7/1989 | Barthel et al. | |
| 4,852,364 | A | 8/1989 | Seener et al. | |
| 4,854,130 | A | 8/1989 | Naruse et al. | |
| 4,888,957 | A | 12/1989 | Chmielewski | |
| 4,938,032 | A | 7/1990 | Mudford | |
| 4,942,740 | A | 7/1990 | Shaw et al. | |
| 4,947,655 | A | 8/1990 | Shaw | |
| 4,955,205 | A | 9/1990 | Wilkinson | |
| 4,955,207 | A | 9/1990 | Mink | |
| 4,979,372 | A | 12/1990 | Tanaka | |
| 4,984,433 | A | 1/1991 | Worthington | |
| 5,050,393 | A | 9/1991 | Bryant | |
| 5,058,388 | A | 10/1991 | Shaw et al. | |
| 5,062,276 | A | 11/1991 | Dudley | |
| 5,065,591 | A | 11/1991 | Shaw | |
| 5,070,707 | A | 12/1991 | Ni | |
| 5,072,597 | A | 12/1991 | Bromley et al. | |
| 5,076,068 | A | 12/1991 | Mikhail | |
| 5,094,598 | A | 3/1992 | Amata et al. | |
| 5,107,906 | A | 4/1992 | Swenson et al. | |
| 5,129,234 | A | 7/1992 | Alford | |
| 5,131,237 | A | 7/1992 | Valbjorn | |
| 5,168,715 | A | 12/1992 | Nakao et al. | |
| 5,181,552 | A | 1/1993 | Eiermann | |
| 5,195,331 | A | 3/1993 | Zimmerman et al. | |
| 5,231,845 | A | 8/1993 | Sumitani et al. | |
| 5,249,433 | A | 10/1993 | Hardison et al. | |
| 5,251,459 | A | 10/1993 | Grass et al. | |
| 5,253,482 | A | 10/1993 | Murway | |
| 5,291,941 | A | 3/1994 | Enomoto et al. | |
| 5,303,561 | A | 4/1994 | Bahel et al. | |
| 5,305,610 | A | 4/1994 | Bennett et al. | |
| 5,309,725 | A | 5/1994 | Cayce | |
| 5,329,781 | A | 7/1994 | Farrey et al. | |
| 5,355,323 | A | 10/1994 | Bae | |
| 5,377,498 | A | 1/1995 | Cur et al. | |
| 5,408,835 | A | 4/1995 | Anderson | |
| 5,423,480 | A | 6/1995 | Heffner et al. | |
| 5,440,894 | A | 8/1995 | Schaeffer et al. | |
| 5,509,272 | A | 4/1996 | Hyde | |
| 5,515,695 | A | 5/1996 | Sakakibara et al. | |
| 5,520,004 | A | 5/1996 | Jones, III | |
| 5,544,809 | A | 8/1996 | Keating et al. | |
| 5,586,441 | A | 12/1996 | Wilson et al. | |
| 5,597,117 | A | 1/1997 | Watanabe et al. | |
| 5,598,715 | A | 2/1997 | Edmisten | |
| 5,609,036 | A | 3/1997 | Nagasawa et al. | 62/225 X |
| 5,615,560 | A | 4/1997 | Inoue | |
| 5,622,055 | A | 4/1997 | Mei et al. | |
| 5,622,057 | A | 4/1997 | Bussjager et al. | |
| 5,634,355 | A | 6/1997 | Cheng et al. | |
| 5,651,258 | A | 7/1997 | Harris | |
| 5,678,417 | A | 10/1997 | Nigo et al. | |
| 5,689,962 | A | 11/1997 | Rafalovich | |
| 5,692,387 | A | 12/1997 | Alsenz et al. | |
| 5,694,782 | A | 12/1997 | Alsenz | |
| 5,706,665 | A | 1/1998 | Gregory | |
| 5,706,666 | A | 1/1998 | Yamanaka et al. | |
| 5,743,100 | A | 4/1998 | Welguisz et al. | |
| 5,752,390 | A | 5/1998 | Hyde | |
| 5,765,391 | A | 6/1998 | Lee et al. | |

| | | | |
|---|---|---|---|
| 5,806,321 | A | 9/1998 | Bendtsen et al. |
| 5,813,242 | A | 9/1998 | Lawrence et al. |
| 5,826,438 | A | 10/1998 | Ohishi et al. |
| 5,839,505 | A | 11/1998 | Ludwig et al. |
| 5,842,352 | A | 12/1998 | Gregory |
| 5,845,511 | A | 12/1998 | Okada et al. |
| 5,850,968 | A | 12/1998 | Jokinen |
| 5,862,676 | A | 1/1999 | Kim et al. |
| 5,867,998 | A | 2/1999 | Guertin |
| 5,887,651 | A | 3/1999 | Meyer |
| 5,964,099 | A | 10/1999 | Kim |
| 5,987,916 | A | 11/1999 | Egbert |
| 6,318,118 | B2 | 11/2001 | Hanson et al. |

FOREIGN PATENT DOCUMENTS

| | | |
|---|---|---|
| EP | 0 355 180 A2 | 2/1990 |
| EP | 0355180 | 2/1990 |
| JP | 58146778 | 9/1983 |
| JP | 03020577 | 1/1991 |
| JP | 10325630 | 8/1998 |
| JP | 10306958 | 11/1998 |
| WO | WO 93/06422 | 4/1993 |
| WO | WO 95/03515 | 2/1995 |
| WO | WO 98/03827 | 1/1998 |
| WO | WO 98/57104 | 12/1998 |

OTHER PUBLICATIONS

04001275; Tomomi et al., Air Conditioner; Dec. 18, 1992; Pub. No. 04–366375; p. 69.

Kominkiewicz, Frank, Memo, dated Feb. 17, 2000, Subject "Tecogen Chiller", 6 pages.

Vienna–Tyler Dec. Case, Memo, dated Feb. 25, 2000, Compressor Model D6VD12, Ser. N159282.

VAPOR COMPRESSION SYSTEM AND METHOD

CROSS-REFERENCE TO RELATED APPLICATION

This application is a continuation-in-part of my application Ser. No. 09/228,696, filed Jan. 12, 1999, U.S. Pat. No. 6,314,747.

FIELD OF THE INVENTION

The present invention generally relates to vapor compression systems and, more particularly, to vapor compression refrigeration, freezer and air conditioning systems. In this regard, an important aspect of the present invention concerns improvements in the efficiency of vapor compression refrigeration systems which are advantageously suited for use in commercial medium and low temperature refrigeration/freezer applications.

BACKGROUND OF THE INVENTION

Vapor compression refrigeration systems typically employ a fluid refrigerant medium that is directed through various phases or states to attain successive heat exchange functions. These systems generally employ a compressor which receives refrigerant in a vapor state (typically in the form of a super heated vapor) and compresses that vapor to a higher pressure which is then supplied to a condenser wherein a cooling medium comes into indirect contact with the incoming high pressure vapor, removing latent heat from the refrigerant and issuing liquid refrigerant at or below its boiling point corresponding to the condensing pressure. This refrigerant liquid is then fed to an expansion device, for example, an expansion valve or capillary tube, which effects a controlled reduction in the pressure and temperature of the refrigerant and also serves to meter the liquid into the evaporator in an amount equal to that required to provide the intended refrigeration effect. As suggested in the prior art, for example, U.S. Pat. No. 4,888,957, a flashing into vapor of a small portion of the liquid refrigerant can occur, however, in such instances, the discharge from the valve is in the form of a low temperature liquid refrigerant with a small vapor fraction. The low temperature liquid refrigerant is vaporized in the evaporator by heat transferred thereto from the ambient environment to be cooled. Refrigerant vapor discharged from the compressor is then returned to the compressor for continuous cycling as described above.

As described in my co-pending U.S. application Ser. No. 09/228,696, the disclosure of which is herein incorporated by reference, for high efficiency operation, it is desired to efficiently utilize as much of the cooling coil in the evaporator as possible. Such high-efficiency operation entails maximum utilization of the latent heat of evaporation along as much of the cooling coil(s) as possible.

Typical prior art systems, particularly those employed in commercial refrigeration/freezer systems, however, commonly utilize a condenser which communicates with the expansion device (e.g. a thermostatic expansion valve) through relatively long refrigeration lines and, in addition, place the expansion device in close proximity to the evaporator. As a result, refrigerant is supplied to the evaporator, in liquid form or substantially in liquid form with only a small vapor fraction. This refrigerant feed and the low flow rates inherently associated therewith produce relatively inefficient cooling particularly along the initial portions of the cooling coil(s) resulting in the build-up of frost or ice at such locations which further reduces the heat transfer efficiency thereof. In commercial systems, such as open refrigerated display cabinets, the build-up of frost can reduce the rate of air flow to such an extent that an air curtain is weakened resulting in an increased load on the case. Moreover, this build-up of frost or ice on the evaporator cooling coils necessitates frequent defrosting, thereby reducing the shelf-life of food products contained in the refrigeration/freezer cabinets and increasing the power consumption and cost of operation.

SUMMARY OF THE PRESENT INVENTION

The present invention overcomes the foregoing problems and disadvantages of conventional vapor compression refrigeration systems by providing a vapor compression refrigeration system in which the inlet to the evaporator is supplied with a refrigerant liquid and vapor mixture wherein the amount of vapor in, and the flow rate of, the mixture at the inlet (and throughout the refrigerant path) cooperate to achieve and maintain improved heat transfer along substantially the entire length of the cooling coil(s) in the evaporator.

It is, therefore, an object of the present invention as to provide a vapor compression refrigeration method and apparatus having improved heat transfer efficiency along substantially the entire length of the cooling coils in the evaporator.

Another object of the present invention is to provide a vapor compression refrigeration method and apparatus wherein the build-up of ice or frost on the surfaces of the cooling coils, particularly those cooling coil surfaces closest to the evaporator inlet, is substantially reduced, thereby significantly minimizing the need for the defrosting thereof.

Another object of the present invention is to provide a vapor compression refrigeration method and apparatus wherein the build-up of moisture or frost on the surfaces of product contained in refrigeration cases and freezers associated therewith is significantly reduced, if not virtually eliminated.

Another object of the present invention is to provide a vapor compression refrigeration method and apparatus characterized by improved temperature consistency along the entire length of the cooling coils thereof.

Another object of the present invention is to provide a vapor compression refrigeration method and apparatus characterized by reduced power consumption and cost of operation.

Another object of the present invention is to provide a vapor compression refrigeration method and apparatus having improved heat transfer efficiency and reduced refrigerant charge requirements, enabling in many applications the elimination of traditional components such as, for example, a receiver in the refrigeration circuit.

Another object of the present invention is to provide a vapor compression refrigeration method and apparatus wherein the temperature differential between the cooling coils and air circulated in heat exchange relationship therewith is minimized, resulting in substantially reduced extraction of the water content in that air and the maintenance of more uniform humidity levels in refrigeration cases and freezer compartments associated therewith.

Another object of the present invention is to provide a commercial refrigeration system wherein the compressor, expansion device and condenser can be remotely located from the refrigeration or freezer compartment associated therewith, thereby facilitating the servicing of those components without interference with customer traffic and the like.

Another object of the present invention is to provide a vapor compression refrigeration system wherein the compressor, expansion device and condenser, together with their associated controls, are contained as a group in a compact housing which can be easily installed in a refrigeration circuit.

These and other objects of the present invention will be apparent to those skilled in this art from the following detailed description of the accompanying drawings and charts wherein like reference numerals indicate corresponding parts and which:

DETAILED DESCRIPTION OF THE PREFERRED EMBODIMENTS

Figure 1:
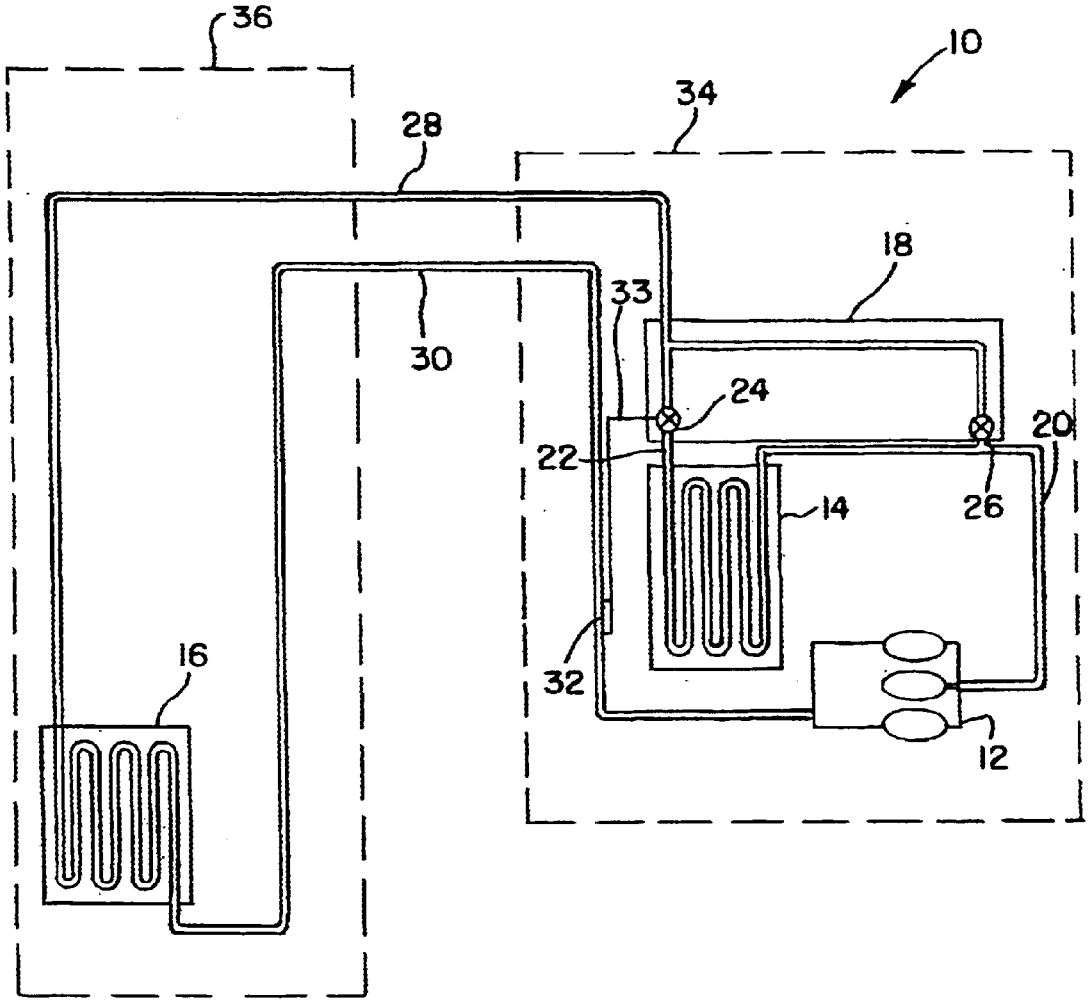
FIG. 1 is a schematic drawing of a vapor-compression system in accordance with one embodiment of the present invention.

A vapor compression system 10 arranged in accordance with one embodiment of the present invention is illustrated in FIG. 1. Refrigeration system 10 includes a compressor 12, a condenser 14, an evaporator 16 and a multifunctional valve or device 18. In this regard, it should be noted, however, that while the multifunctional valve or device 18 shown in FIG. 1 is described in greater detail as a preferred form of expansion device, other expansion devices can be used in accordance with, and are encompassed within the scope of the present invention. These include, for example, thermostatic expansion valves, capillary tubes, automatic expansion valves, electronic expansion valves, and other devices for reducing or controlling the pressure and/or temperature of a liquid refrigerant.

As shown in FIG. 1, compressor 12 is coupled to condenser 14 by a discharge line 20. Multifunctional valve or device 18 is coupled to condenser 14 by a liquid line 22 coupled to a first inlet 24 of multifunctional valve 18. Additionally, multifunctional valve 18 is coupled to the discharge line 20 at a second inlet 26. An evaporator feed line 28 couples multifunctional valve or device 18 to evaporator 16, and a suction line 30 couples the outlet of the evaporator 16 to the inlet of compressor 12. A temperature sensor 32 is mounted to suction line 30 and is operatively connected to multifunctional valve 18 through a control line 33. In accordance with an important aspect of the present invention, compressor 12, condenser 14, multifunctional valve or device 18 (or other suitable expansion device) and temperature sensor 32 are located within a control unit 34 which can be remotely located from a refrigeration case 36 in which evaporator 16 is located.

The vapor compression refrigeration system of the present invention can utilize essentially any commercially available heat transfer fluid including refrigerants such as chlorofluorocarbons, for example, R-12 which is a dichlorofluoromethane, R-22 which is a monochloroflueromethane, R-500 which is an azeotropic refrigerant consisting of R-12 and R-152a, R-503 which is an azeotropic refrigerant consisting f R-23 and R-13, R-502 which is an azeotropic refrigerant consisting of R-22 and R-115. Other illustrative refrigerants include, but are not limited to, R-13, R-113, 141b, 123a, 123, R-114 and R-11. Additionally, the present invention can also be used with other types of refrigerants such as, for example, hydrochlorofluorocarbons such as 141b, 123a, 123 and 124 as well as hydrofluorocarbons such as R134a, 134, 152, 143a, 125, 32, 23 and the azeotropic HFCs AZ-20 and AZ-50 (commonly known as R-507). Blended refrigerants such as MP-39, HP-80, FC-14, R-717, and HP-62 (commonly known as R-404a), are additional refrigerants. Accordingly, it should be appreciated that the particular refrigerant or combination of refrigerants utilized in the present invention is not deemed to be critical to the operation of the present inventions since this invention is expected to operate with a greater system efficiency with virtually all refrigerants than is achievable by any previously known vapor compression refrigeration system utilizing the same refrigerant.

In operation, compressor 12 compresses the refrigerant fluid (vapor discharge from evaporator 16) to a relatively high pressure and temperature. The temperature and pressure to which this refrigerant is compressed by compressor 12 will depend upon the particular size of the refrigeration system 10 and the cooling load requirements. Compressor 12 pumps the high pressure vapor into discharge line 20 and into condenser 14. As will be described in more detail below, during cooling operations, second inlet 26 is closed and the entire output of compressor 12 is pumped through condenser 14.

In condenser 14, a medium such as air and water is blown past coils within the condenser causing the pressurized heat transfer fluid to change to the liquid state. The temperature of the liquid refrigerant drops by about 10 to 40° F., depending upon the particular refrigerant employed as the latent heat within the refrigerant fluid is expelled during the condensing process. Condenser 14 discharges the liquified refrigerant to liquid line 22. As shown in FIG. 1, liquid line 22 immediately discharges into multifunctional valve or device 18. Since liquid line 22 is relatively short, the liquid carried by line 22 does not substantially increase or decrease in temperature or pressure as it passes from condenser 14 to multifunctional valve or device 18.

By configuring refrigeration system 10 to have a short liquid line, refrigeration system 10 advantageously delivers substantial amounts of liquid refrigerant to multifunctional valve or device 18 at a low temperature and high pressure with little of the heat absorbing capabilities of the liquid refrigerant being lost by the minimal warming of the liquid before it enters multifunctional valve or device 18, or by a loss in liquid pressure.

The heat transfer fluid discharge by condenser 14 enters multifunctional valve or device 18 at a first inlet 24 and undergoes a volumetric expansion at a rate determined by the temperature of suction line 30 at temperature sensor 32. Multifunctional valve or device 18 discharges the heat transfer fluid as a mixture of refrigerant liquid and vapor into evaporator feed line 28. Temperature sensor 32 relays temperature information through a control line 33 to multifunctional valve 18. It will be appreciated by those skilled in this art that the refrigeration system 10 can be used in a wide variety of applications for controlling the temperature of an enclosure, such as a refrigeration case where perishable food items are stored.

Those skilled in this art will further recognize that the positioning of a valve for volumetrically expanding the refrigerant fluid in close proximity to the condenser, and the relative great length of evaporator feed line 28 between the expansion device 18 and evaporator 16, differs considerably from systems of the prior art. For example, in typical prior art systems, an expansion device is positioned immediately adjacent to the inlet of the evaporator and, if a temperature sensing device is used, that temperature sensing device is typically mounted in close proximity to the outlet of the evaporator. As previously described, such systems suffer from poor efficiency because the evaporator is typically supplied with refrigerant in liquid form or substantially in liquid form with only a small vapor fraction which, coupled with the low flow inherently associated therewith, produce relatively inefficient cooling particularly at the initial portions of the cooling coil.

In contrast to the prior art, the vapor compression refrigeration system of the present invention utilizes an evaporator feed line which by virtue of its diameter and length facilitates the conversion of liquid to a liquid and vapor mixture during its travel from the expansion device (e.g. multifunctional valve or device 18) to the evaporator. As a result, a significant amount of the liquid component thereof is converted to a vapor resulting in the refrigeration feed to the inlet of evaporator 16 having a substantial vapor content and a correspondingly high rate of flow which provides substantially improved heat transfer along substantially the entire length of the cooling coil(s). This improved heat transfer efficiency can also be accompanied by other benefits and advantages. For example, the build-up of ice or frost on the surfaces of the cooling coil, particularly those cooling coil surfaces closest to the evaporator inlet, is substantially reduced, thereby significantly minimizing the need for defrosting the same. Furthermore, the temperature differential between the cooling coils and air circulated in heat exchange relationship therewith is minimized, thereby providing more uniform humidity levels in the refrigeration cases and freezer compartments associated therewith and virtually eliminating the build-up of moisture or frost on the surfaces of product contained in those refrigeration cases and freezers. Additionally, the systems of the present invention are characterized by reduced power consumption and cost of operation since the portion of the operating cycle during which a compressor is running is significantly less than with conventional refrigeration/freezer systems operating under the same loads.

Figure 2:
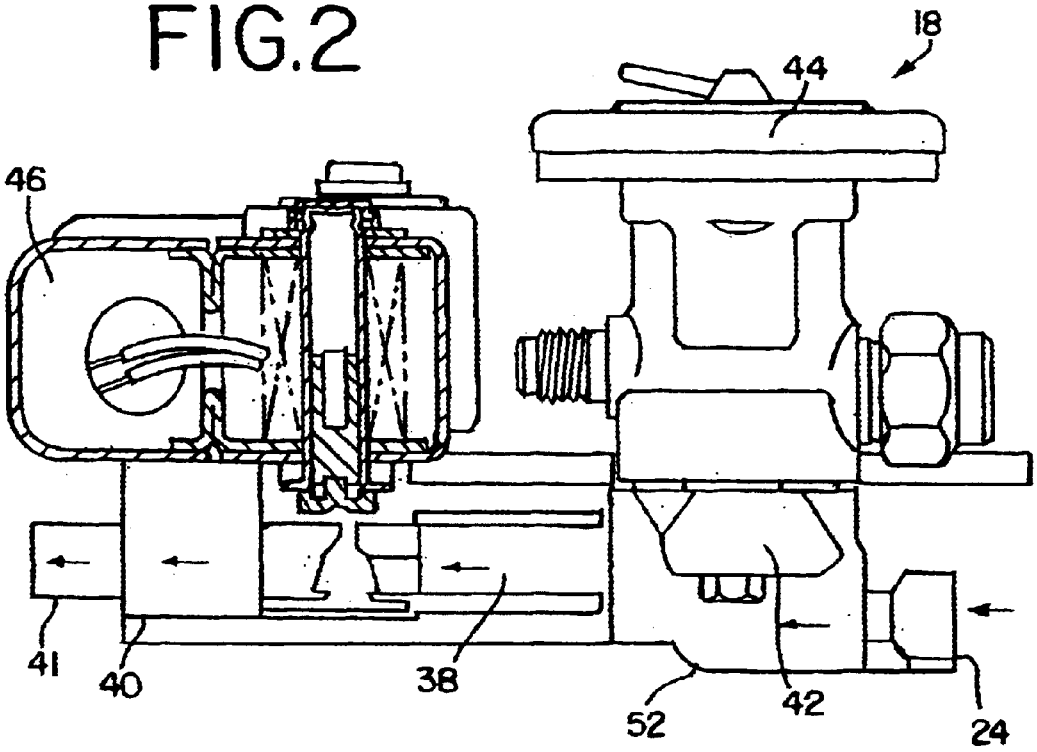
FIG. 2 is a side view, partially in cross-section, of a first side of a multifunctional valve or device in accordance with one embodiment of the present invention.

Referring to FIG. 2, heat transfer fluid (high pressure refrigerant vapor) enters first inlet 24 and traverses a first passageway 38 to a common chamber 40. An expansion valve 42 is positioned adjacent the first passageway 38 near first inlet 24. Expansion valve 42 meters the flow of the heat transfer fluid through first passageway 38 by means of a diaphragm (not shown) enclosed within an upper valve housing 44. In the illustrated embodiment, the refrigerant feed undergoes a two-stage series expansion, the first expansion occurring in the expansion valve 42 being a modulated expansion when, for example, the expansion valve 42 is a thermostatic expansion valve, and the second expansion in the common chamber 40 being a continuous or non-modulated expansion.

Control line 33 is connected to an input 62 located on upper valve housing 44. Signals relayed through control line 33 activate the diaphragm within upper valve housing 44. The diaphragm actuates a valve assembly 54 (shown in FIG. 4) to control the amount of heat transfer fluid entering an expansion chamber (shown in FIG. 4) from first inlet 24. A gating valve 46 is positioned in first passageway 48 near common chamber 40. In a preferred embodiment to the invention, gating valve 46 is a solenoid valve capable of terminating the flow of heat transfer fluid through first passageway 38 in response to an electrical signal.

Figure 3:
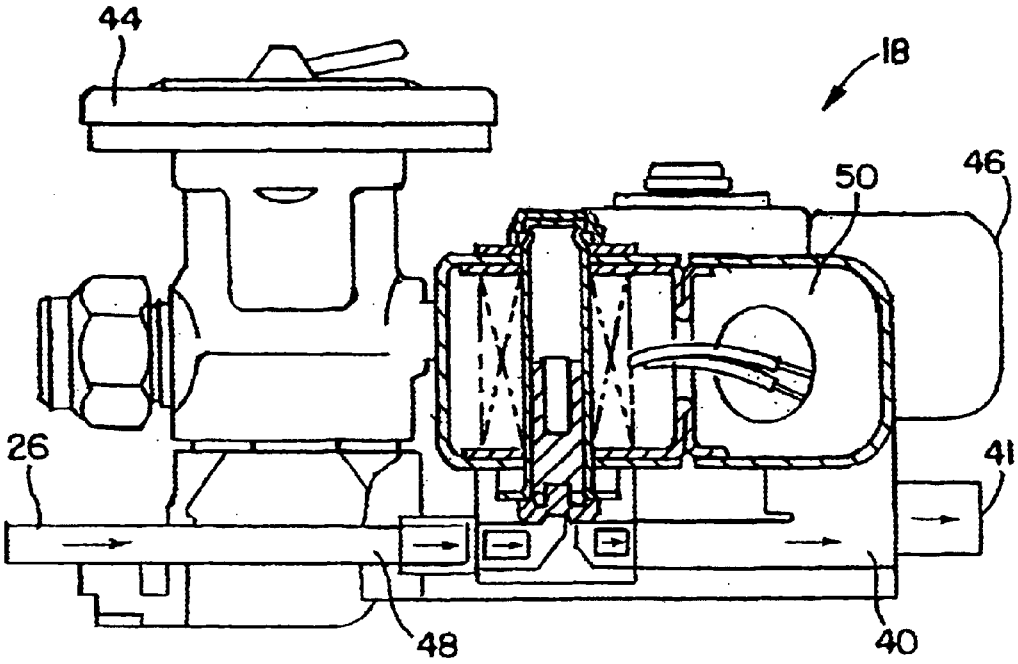
FIG. 3 is a side view partially in cross-section, of a second side of the multifunctional valve or device illustrated in FIG. 2.

As shown in FIG. 3, a second passageway 48 of multifunctional valve or device 18 couples second inlet 26 to common chamber 40. Refrigerant fluid undergoes volumetric expansion as it enters common chamber 40. A gating valve 50 is positioned in second passageway 48 near common chamber 40. In a preferred embodiment of the invention, gating valve 50 is a solenoid valve capable of terminating the flow of heat transfer fluid through second passageway 48 upon receiving an electrical signal. Common chamber 40 discharges the heat transfer fluid from multifunctional valve or device 18 through an outlet 41.

Figure 4:
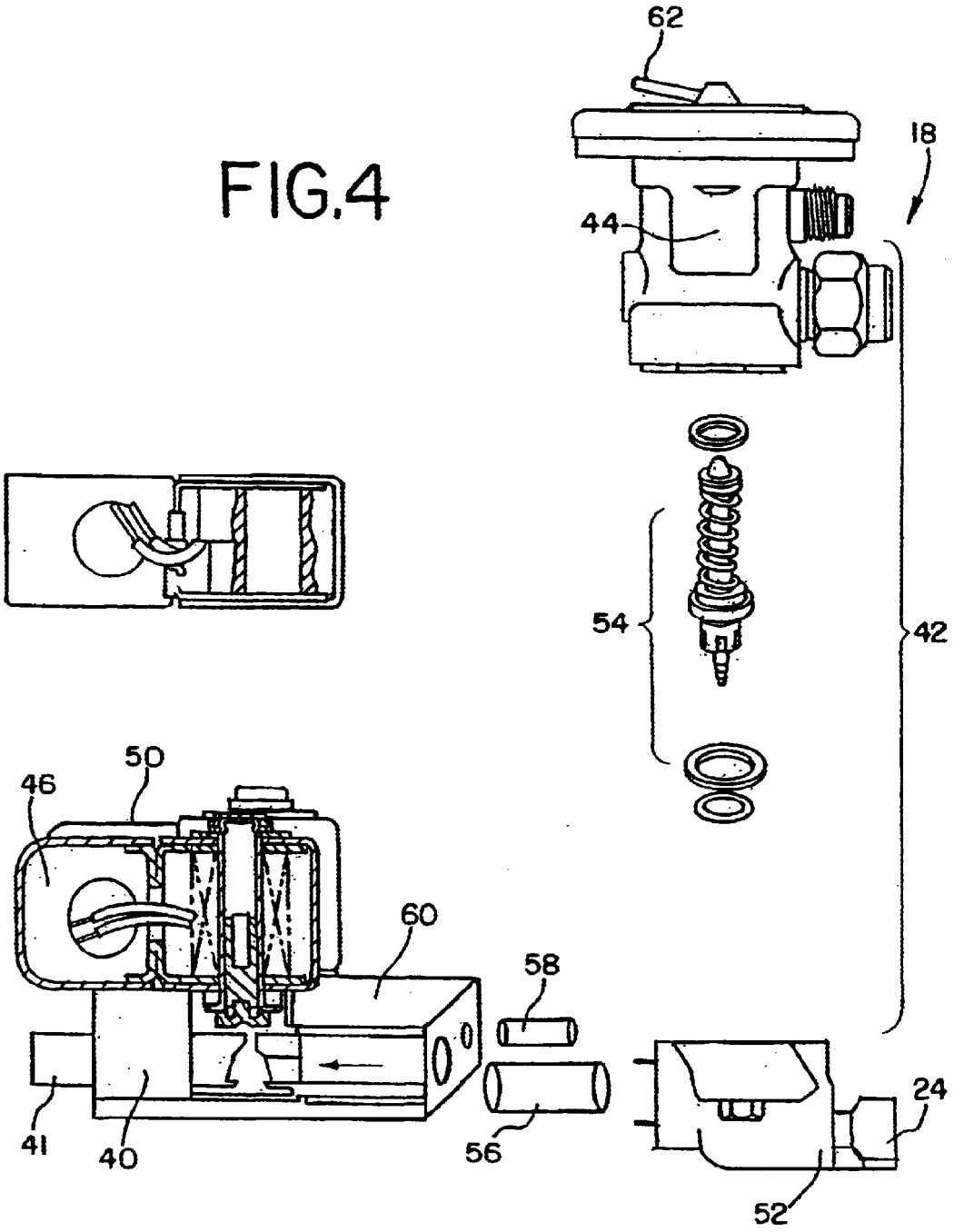
FIG. 4 is an exploded view, partially in cross-section, of the multifunctional valve or device illustrated in FIGS. 2 and 3.

As shown in FIG. 4, multifunctional valve 18 includes expansion chamber 52 adjacent first inlet 22, valve assembly 54, and upper valve housing 44. Valve assembly 54 is actuated by a diaphragm (not shown) contained within the upper valve housing 44. First and second tubes 56 and 57 are located intermediate to expansion chamber 40 and a valve body 60. Gating valves 46 and 50 are mounted on valve body 60.

In accordance with another aspect of the present invention, refrigeration system 10 can be operated in a defrost mode by closing gating valve 46 and opening gating valve 50. In the defrost mode, high temperature heat transfer fluid enters second inlet 26 and traverses second passageway 48 and enters common chamber 40. The high temperature vapors are discharged through outlet 41 and traverse evaporator feed line 28 which discharges directly into the inlet of the cooling coil in evaporator 16.

During the defrost cycle, any pockets of oil trapped in the system will be warmed and carried in the same direction of flow as the heat transfer fluid. By forcing hot gas through the system in a forward direction, the trapped oil will eventually be returned to the compressor. Hot gas will travel through the system at a relatively high velocity, giving the gas less time to cool, thereby improving the defrosting efficiency. The forward flow defrost method of the invention offers numerous advantages to a reverse flow defrost method. For example, reverse flow defrost systems employ a small diameter check valve near the inlet of the evaporator. The check valve restricts the flow of hot gas in the reverse direction reducing its velocity and hence its defrosting efficiency. Furthermore, the forward flow defrost method of the invention avoids pressure buildup in the system during the defrost system. Additionally, reverse flow methods tend to push oil trapped in the system back into the expansion valve. This is undesirable since excess oil in the expansion valve can cause gumming that restricts the operation of a valve. Also, with forward defrost, the liquid line pressure is not reduced in any additional refrigerant circuits being operated in addition to the defrost circuit.

The forward flow defrost capability of the invention also offers numerous operating benefits as a result of improved defrosting efficiency. For example, by forcing trapped oil back into the compressor, liquid slugging is avoided, which has the effect of increasing the useful life of the equipment. Furthermore, reduced operating costs are realized because less time is required to defrost the system. Since a flow of hot gas can be quickly terminated, the system can be rapidly returned to normal cooling operations. When frost is removed from evaporator 16, temperature sensor 32 detects a temperature increase and the heat transfer fluid in suction line 30. When the temperature rises to a given set point, gating valve 50 in multifunctional valve 18 is closed and the system is ready to resume refrigeration operation.

It will be appreciated by those skilled in this art, that numerous modifications can be made to enable the refrigeration system of this invention to address a variety of applications. For example, refrigeration systems operating in retail food outlets typically include a number of refrigeration cases that can be serviced by a common compressor system. Also, in applications requiring refrigeration with high thermal loads, multiple compressors can be used to increase the cooling capacity of the refrigeration system. Illustrations of such arrangements are shown and described in the aforementioned copending application Ser. No. 09/228,696 whose disclosure with respect to such alternate systems is incorporated herein by reference.

The following examples are provided for purposes of illustrating the performance and advantages of the vapor compression refrigeration system of the present invention in comparison with conventional refrigeration systems.

EXAMPLE I

The refrigeration circuit of a 5 foot (1.52 m) Tyler Chest Freezer was equipped with a multifunctional device of the type described herein, valve in a refrigeration circuit, and a standard expansion valve which was plumbed into a bypass line so that the refrigeration circuit could be operated as a conventional refrigeration system and as an XDX refrigeration system arranged in accordance with the invention. The refrigeration circuit described above was equipped with an evaporator feed line having an outside tube diameter of about 0.375 inches (0.953 cm) and an effective tube length of about 10 ft. (3.048 m). The refrigeration circuit was powered by a Copeland hermetic compressor. In the XDX mode, the sensing bulb was attached to the suction line about 18 inches from the compressor while in the conventional mode the sensing bulb was adjacent the outlet of evaporator. The circuit was charged with about 28 oz. (792 g) of R-12 refrigerant available from the Du Pont Company. The refrigeration circuit was also equipped with a bypass line extending from the compressor discharge line to the evaporator feed line for forward-flow defrosting (see FIG. 1). All refrigerated ambient air temperature measurements were made by using a "CPS Data Logger" (Model DL300) with a temperature sensor located in the center of the refrigeration case about 4 inches (10 cm) above the floor.

XDX System-Medium Temperature Operation

The nominal operating temperature of the evaporator was 20° F. (−6.7° C.) and the nominal operating temperature of the condenser was 120° F. (48.9° C.). The evaporator handled a cooling load of about 3000 btu/hr (21 g cal/s). The multifunctional valve or device metered a refrigerant liquid/vapor mixture into the evaporator feed line at a temperature of about 20° F. (−6.7° C.). The sensing bulb was set to maintain about 25° F. (°C.) superheating of the vapor flowing from the suction line. The compressor discharged about 2199 ft/min (670 m/min) of pressurized refrigerant into the discharge line at a condensing temperature of about 120° F. (48.9° C.) and a pressure of about 172 lbs/in$^2$.

XDX System-Low Temperature Operation

The nominal operating temperature of the evaporator was −5° F. (−20.5° C.) and the nominal operating temperature of the condenser was 115° F. (46.1° C.). The evaporator handled a cooling load of about 3000 Btu/hr (21 g cal/s). The multifunctional valve or device metered refrigerant into the evaporator feed line at a temperature of about −5° F. (−20.5° C.). The sensing bulb was set to maintain about 20° F. (11.1° C.) superheat of the vapor flowing into the suction line. The compressor discharged pressurized refrigerant vapor into the discharge line at a condensing temperature of about 115° F. (46.1° C.). The XDX System was operated substantially the same in low temperature operation as in medium temperature operation with the exception that the fans of the Tyler Chest Freezer was delayed for 5 minutes following defrost to remove heat from the evaporator coil and to allow water drainage from the coil.

The XDX refrigeration system was operated for a period of about 24 hours in medium temperature operation and at about 18 hours at low temperature operation. The temperature of the ambient air within the Tyler Chest Freezer was measured about every minute during the 23 hour testing period. The air temperature was measured continuously during the testing period, while the refrigeration system was operated in both refrigeration mode and in defrost mode. During defrost cycles, the refrigeration circuit was operated in defrost mode until the sensing bulb temperature reached about 50° F. (10° C.). The temperature measurement statistics appear in Table A below.

Conventional System-Medium Temperature Operation with Electric

The Tyler Chest Freezer described above was equipped with a bypass line extending between the compressor discharge line and the suction line for reverse-flow defrosting. The bypass line was equipped with a solenoid valve to gate the flow of high temperature refrigerant in the line. An electric defrost element was energized to heat the coil. A standard expansion valve was installed immediately adjacent to the evaporator inlet and the temperature sensing bulb was attached to the suction line immediately adjacent to the evaporator outlet. The sensing bulb was set to maintain about 6° F. (3.3° C.) superheating of the vapor flowing in the suction line. Prior to operation, the system was charged with about 48 oz. (1.36 kg) of R-12 refrigerant.

The conventional refrigeration system was operated for a period of about 24 hours at medium temperature operation. The temperature of the ambient air within the Tyler Chest Freezer was measured about every minute during the 24 hour testing period. The air temperature was measured continuously during the testing period, while the refrigeration system was operated in both refrigeration mode and in electric defrost mode. During defrost cycles, the refrigeration circuit was operated in defrost mode until the sensing bulb temperature reached about 50° F. (10° C.). The temperature measurement statistics appear in Table A below.

Conventional System-Medium Temperature Operation with Air Defrost

The Tyler Chest Freezer described above was equipped with a receiver to provide proper liquid supply to the expansion valve and a liquid line dryer was installed to allow for additional refrigerant reserve. The expansion valve and the sensing valve were positioned in the same location as in the electric defrost system described above. The sensing bulb was set to maintain about 8° F. (4.4° C.) superheat of vapor flowing in the suction line. Prior to operation, the system was charged with 34 oz. (0.966 kg) of R-12 refrigerant.

The conventional refrigeration system operated for a period of 24½ hours at medium temperature operation. The temperature of the ambient air within the Tyler Chest Freezer was measured about every minute during the 24½ hour testing period. The air temperature was measured continuously during the testing period while the refrigeration system was operated in both refrigeration mode and in air defrost mode. In accordance with conventional practice, four defrost cycles were programmed with each lasting for about 36 to 40 minutes. The temperature measurement data appear in Table A below.

TABLE A

REFRIGERATION TEMPERATURES (° F./° C.)

| | XDX[1] Medium Temperature | XDX[1] Low Temperature | Conventional[2] Medium Temperature Electric Defrost | Conventional[2] Medium Temperature Air Defrost |
|---|---|---|---|---|
| Average | 38.7/3.7 | 4.7/−15.2 | 39.7/4.3 | 39.6/4.2 |
| Standard Deviation | 0.8 | 0.8 | 4.1 | 4.5 |
| Variance | 0.7 | 0.6 | 16.9 | 20.4 |
| Range | 7.1 | 7.1 | 22.9 | 26.0 |

[1]one defrost cycle during 23 hour test period
[2]three defrost cycles during 24 hour test period As illustrated above, the XDX refrigeration system arranged in accordance with the invention maintains a desired temperature within the chest freezer with less temperature variation than a conventional systems. The standard deviation, the variance and the range of the temperature measurements for the medium temperature data are substantially less for XDX than the conventional systems. Correspondingly, the low temperature data for XDX show that it favorably compares with the XDX medium temperature data.

During defrost cycles, the temperature rise in the chest freezer was monitored to determine the maximum temperature within the freezer. This temperature should be as close to the operating refrigeration temperature as possible to avoid spoilage of food products stored in the freezer. The maximum defrost temperature for the XDX system and for the conventional systems is shown in Table B and Table C.

TABLE B

MAXIMUM DEFROST TEMPERATURE (° F./° C.)

| XDX MEDIUM TEMPERATURE | CONVENTIONAL ELECTRIC DEFROST | CONVENTIONAL AIR DEFROST |
|---|---|---|
| 44.4/6.9 | 55.0/12.8 | 58.4/14.7 |

EXAMPLE II

In the Tyler Chest Freezer equipped with electric defrosting circuits, the low temperature operating test was carried out using the electric defrosting circuit to defrost the evaporator. The time needed for the XDX system and an electric defrost system to complete defrost and to return to the 5° F.(−14.4° C.) operating set point appears in Table C below.

TABLE C

| TIME NEEDED TO RETURN TO REFRIGERATION TEMPERATURE OF 5° F. (−15° C.) FOLLOWING | | |
|---|---|---|
| | XDX | Conventional System with Electric Defrost |
| Defrost Duration (min) | 10 | 36 |
| Recovery Time (min) | 24 | 144 |

As shown above, the XDX system using forward-flow defrost through the multifunctional valve needs less time to completely defrost the evaporator, and substantially less time to return to refrigeration temperature.

EXAMPLE III

This Example compares the performance of a vapor compression refrigeration system of the present invention (the XDX system) with that of a conventional system operating in the medium temperature range.

The refrigeration circuit of an 8 ft. (2.43 m) IFI meat case (Model EM5G-8) was equipped with a multifunctional device as described herein (which included a Sporlan Q-body thermostatic expansion valve). A like thermostatic expansion valve was plumbed into a bypass line so that the refrigeration circuit could be operated either as an XDX refrigeration system or as conventional refrigeration system.

This refrigeration circuit included an evaporator feed line (in the XDX mode) having an outside tube diameter of 0.5 in. (1.27 cm) and a run length (compressor to evaporator) of approximately 35 ft. (10.67 m). The liquid feed line (in the conventional mode) had an outside tube diameter of 0.375 in. (0.95 cm) and approximately the same run length. Both modes of operation used the same condenser, evaporator and suction line which had an outside diameter of 0.875 in. (2.22 cm). In both modes of operation, the refrigeration circuit was powered by a Bitzer Model 2CL-3.2Y compressor.

A sensing bulb was attached to the suction line about two feet (0.61 m) from the compressor in the XDX mode and was coupled to the multifunctional device as described above with respect to FIG. 1. The thermostatic expansion valve component of the multifunctional device was set at 20° F. (11.1° C.) superheat.

In the conventional mode, the thermostatic expansion valve was located adjacent the inlet to the evaporator and the sensor adjacent the evaporator outlet. The valve was set to open when the superheat measured by the sensor was above 8° F. (4.4° C.)

In both modes of operation, the circuits were charged with like amounts of AZ-50 refrigerant and the operating temperature range in the meat case was from 32° F. (0° C.) to 36° F. (2.2° C.). Data measurements were made with a Sponsler Company (Westminster, S.C.) flow meter (Model IT-300N) and vapor flow meter adapted (Model SP1-CB-PH7-A-4X) and a Logic Beach, Inc. (La Mesa, Calif.) Hyperlogger recorder (Model HLI).

Figure 5:
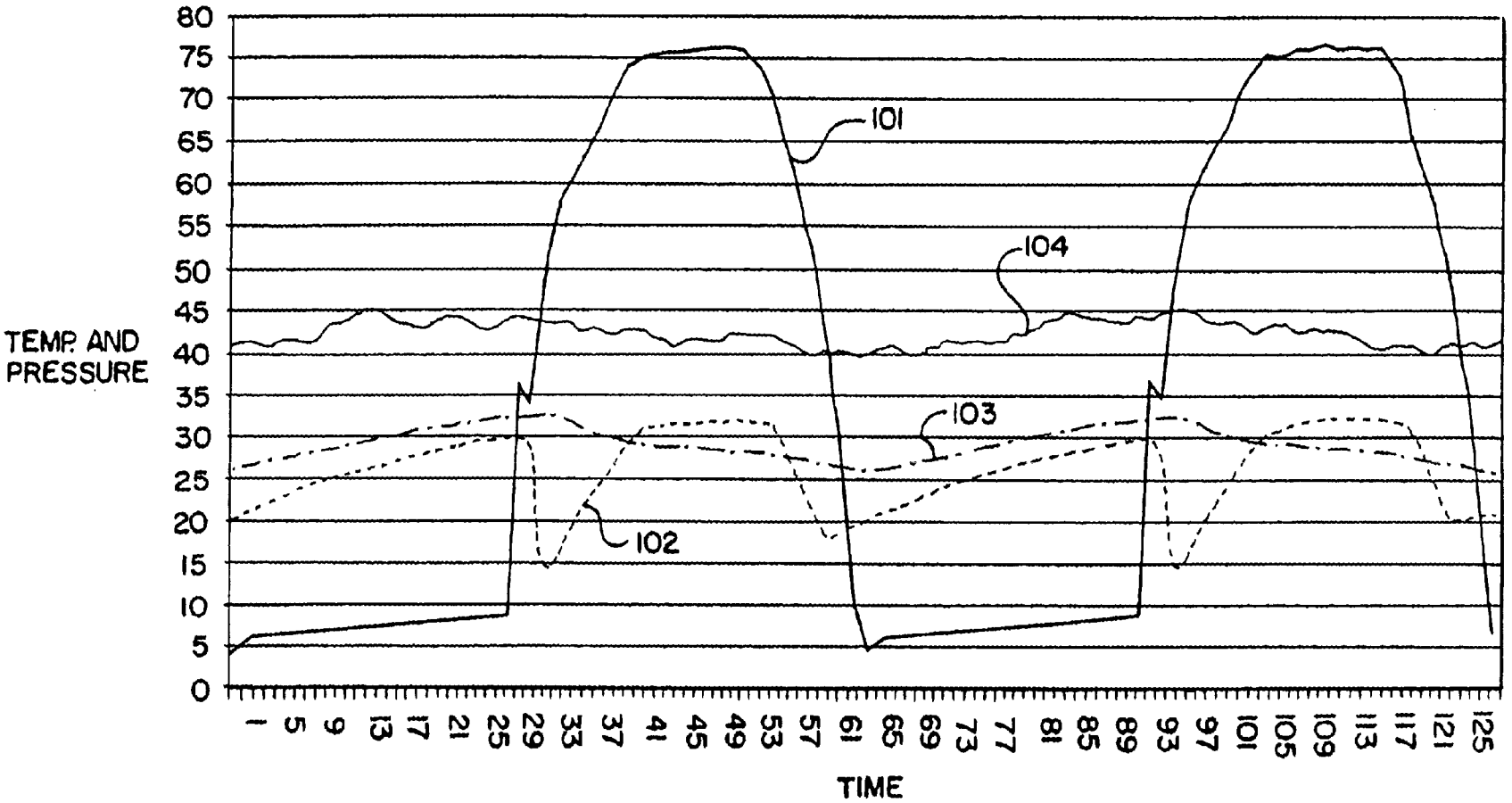
FIG. 5 is a data plot showing the pressure and temperature of refrigerant feed at the inlet to the evaporator as well as the supply air temperature and return air temperature versus time during two operating cycles in a medium temperature vapor compression refrigeration system embodying the present invention.
Figure 6:
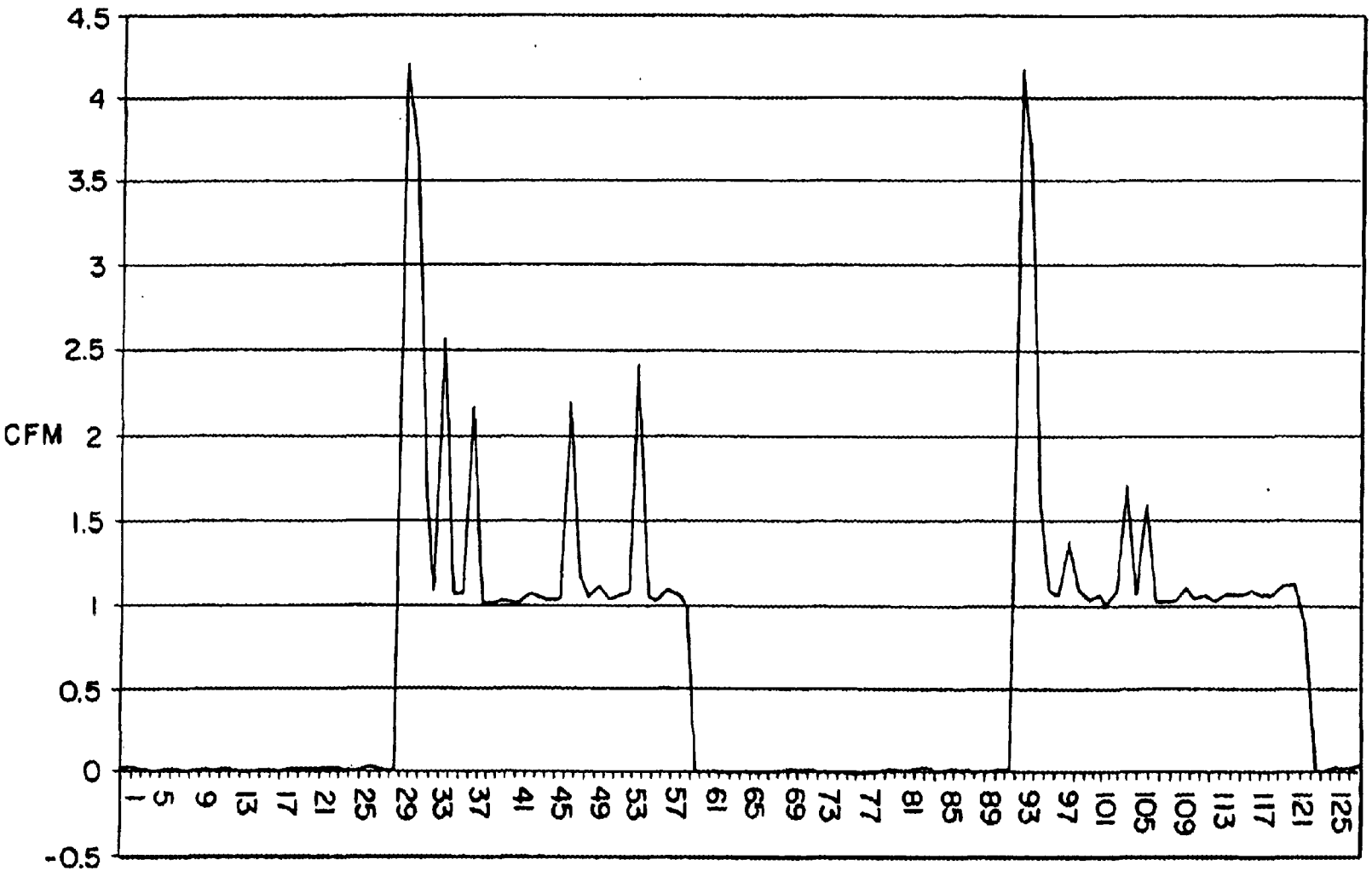
FIG. 6 is a data plot showing the refrigerant feed volumetric flow rate at the inlet to the evaporator versus time during the same two cycles of operation depicted in FIG. 5.

FIGS. 5–8 show refrigerant data collected at the inlet to the evaporator over two representative consecutive operating cycles for the XDX system of this Example. In FIG. 5, refrigerant pressure (psi) and the temperature (°F.) are designated by reference numerals 101 and 102, respectively. The corresponding supply air temperature (°F.) and return air temperature (°F.) are likewise respectively designated by reference numerals 103 and 104. The volumetric flow rate (cfm) is shown in FIG. 6, the density (lbs/ft$^2$) in FIG. 7 and the mass flow rate (lbs/min) in FIG. 8, all for the same two cycles of operation.

Figure 9:
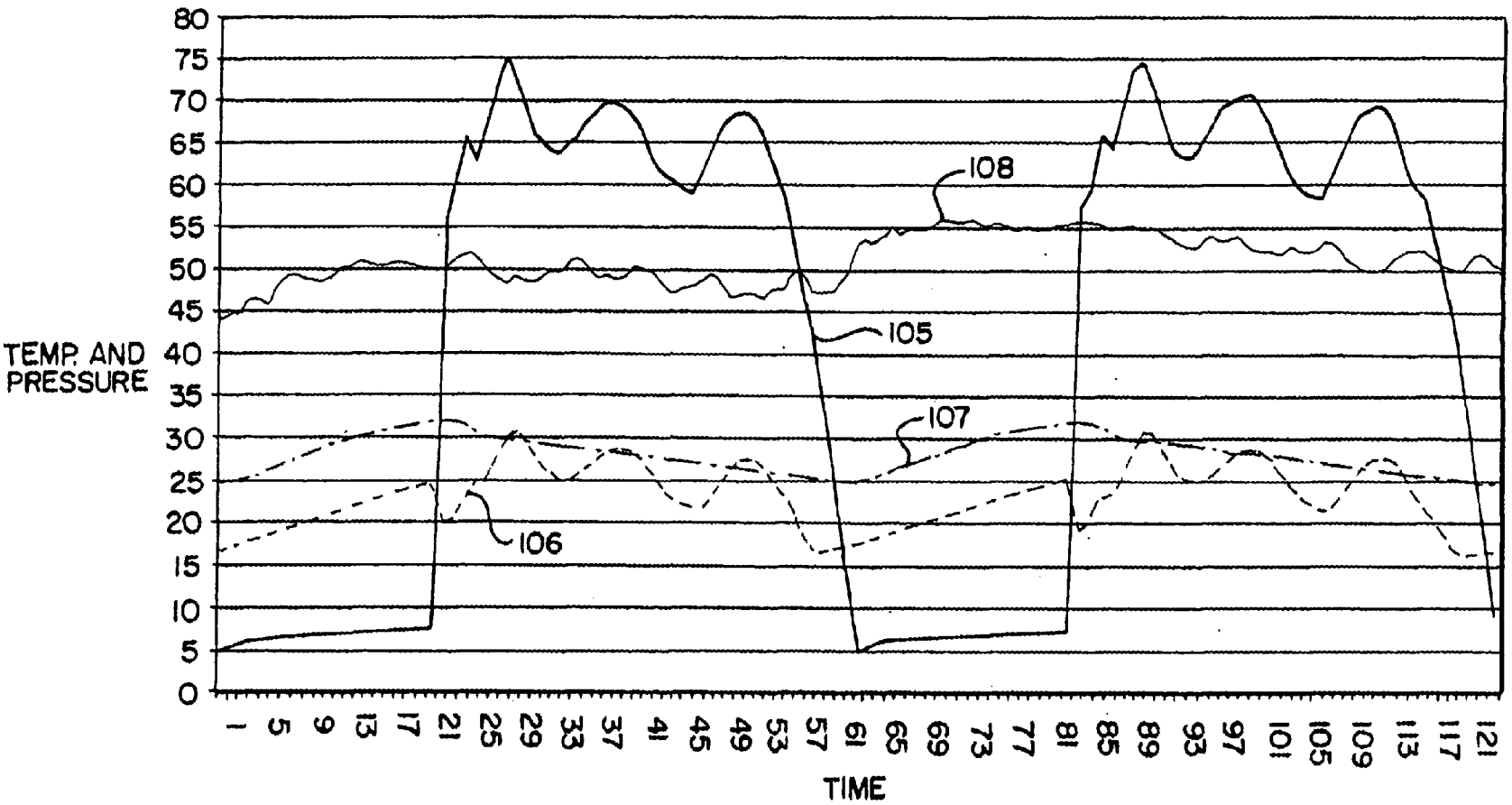
FIG. 9 is a data plot showing the pressure and temperature of refrigerant at the inlet to the evaporator as well as the supply air temperature and return air temperature versus time during two cycles of operation of a conventional medium temperature vapor compression refrigeration system.
Figure 10:
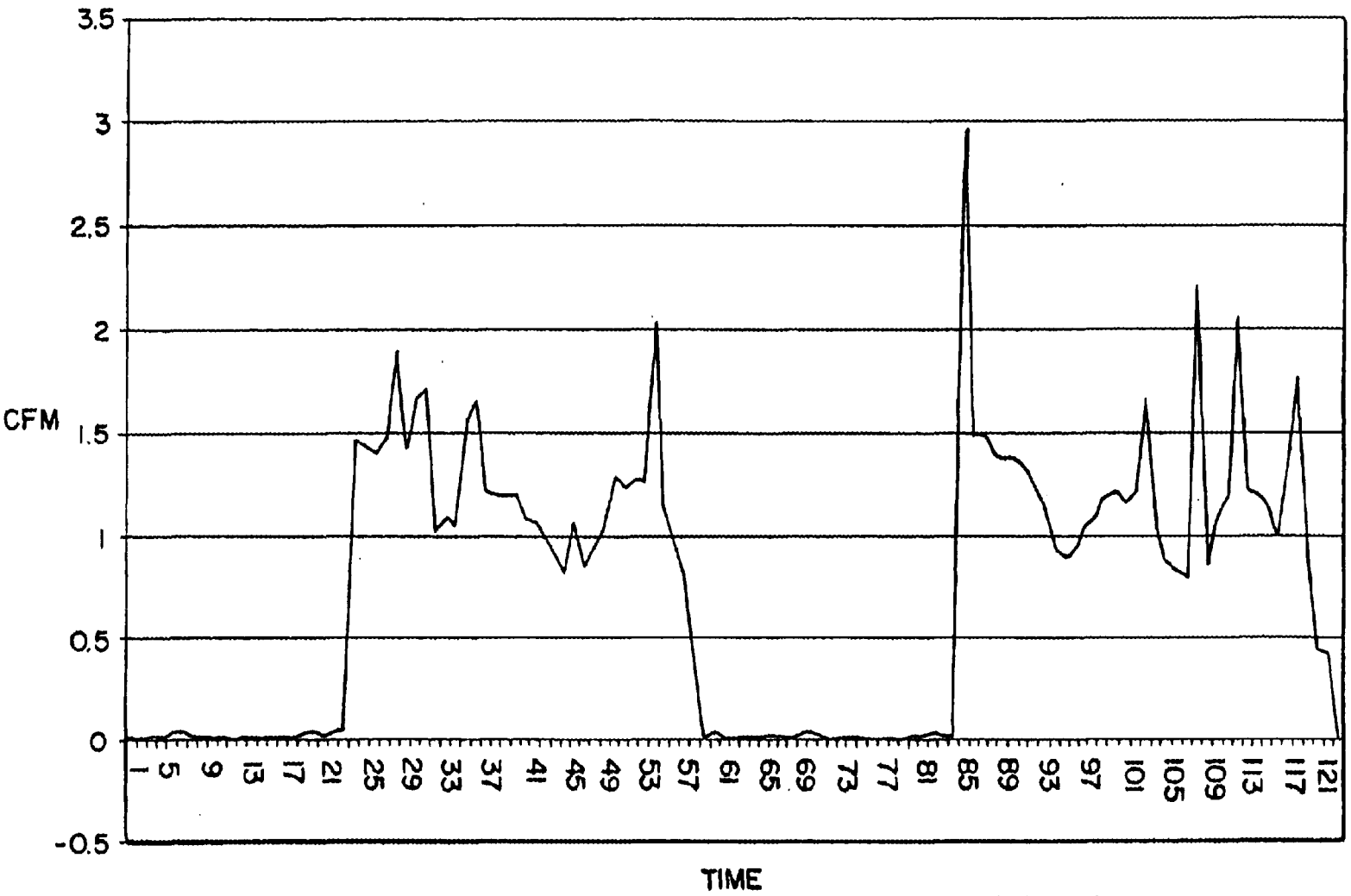
FIG. 10 is a data plot showing the volumetric flow rate of refrigerant feed at the inlet to the evaporator versus time during the same two cycles of operation shown in FIG. 9.

Corresponding refrigerant data collected at the inlet to the evaporator over two representative consecutive operating cycles of the conventional system is shown in FIGS. 9–12. In particular, FIG. 9 is similar to FIG. 5 in that it shows inlet pressure (psi) and temperature (°F.), respectively designated by reference numerals 105 and 106, with the corresponding supply air temperature (°F.) and return air temperature (°F.) being respectively designated by reference numerals 107 and 108. Volumetric flow rate (cfm) as shown in FIG. 10, density (lbs/ft$^2$) and the massive flow rate (lbs/min) are likewise shown in FIGS. 11 and 12 for the conventional refrigerant system.

As can be observed from a comparison of FIGS. 5 and 9, the differential temperature between the supply air and return air in the XDX system is significantly closer than the differential temperature between the supply air and return air in the conventional system. Also, the portion of each operating cycle when the compressor is pumping is of shorter duration for the XDX system than with the conventional system.

Figure 7:
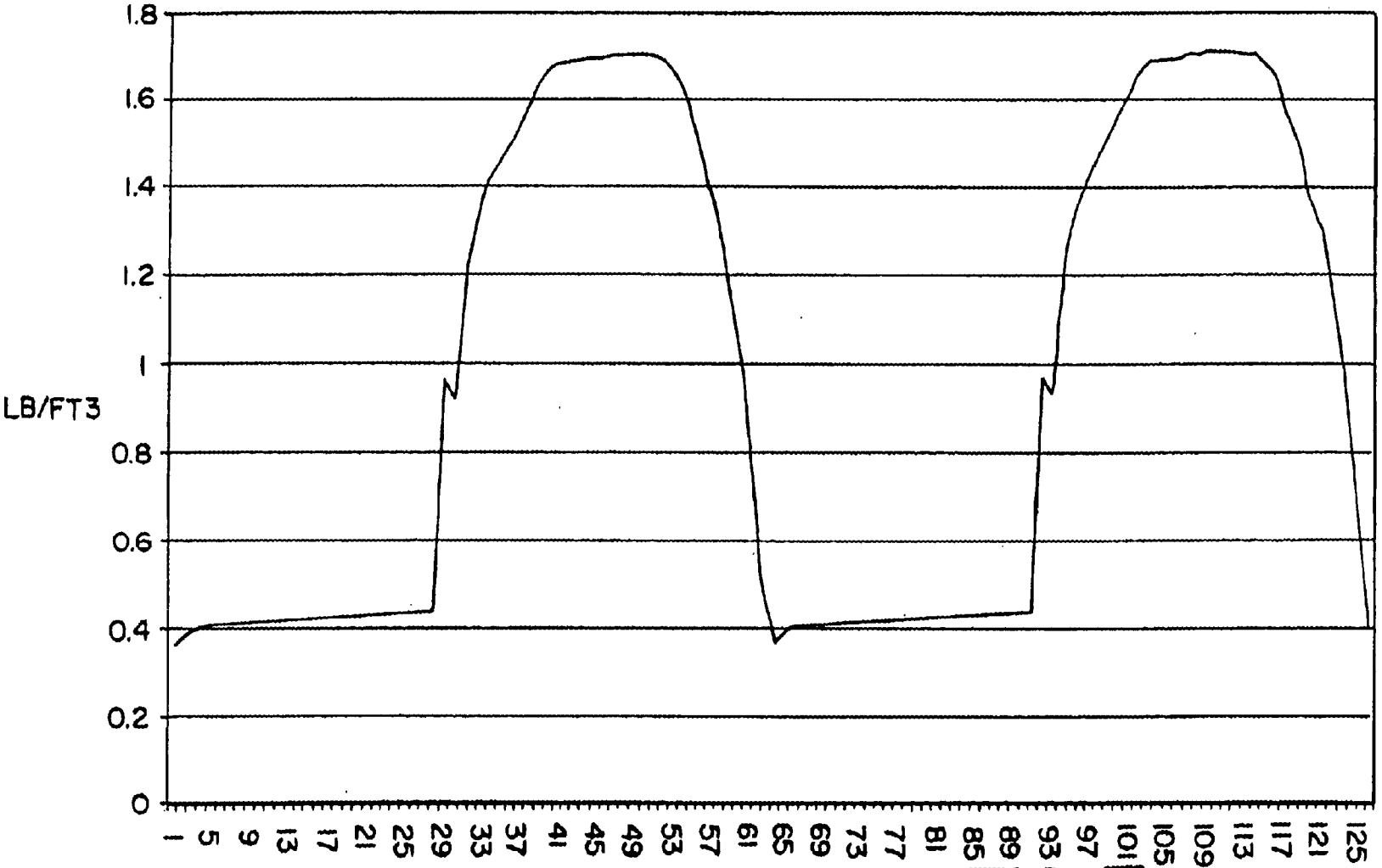
FIG. 7 is a data plot showing the density of the refrigerant feed at the inlet to the evaporator versus time during the same two cycles of operation shown in FIG. 5.
Figure 8:
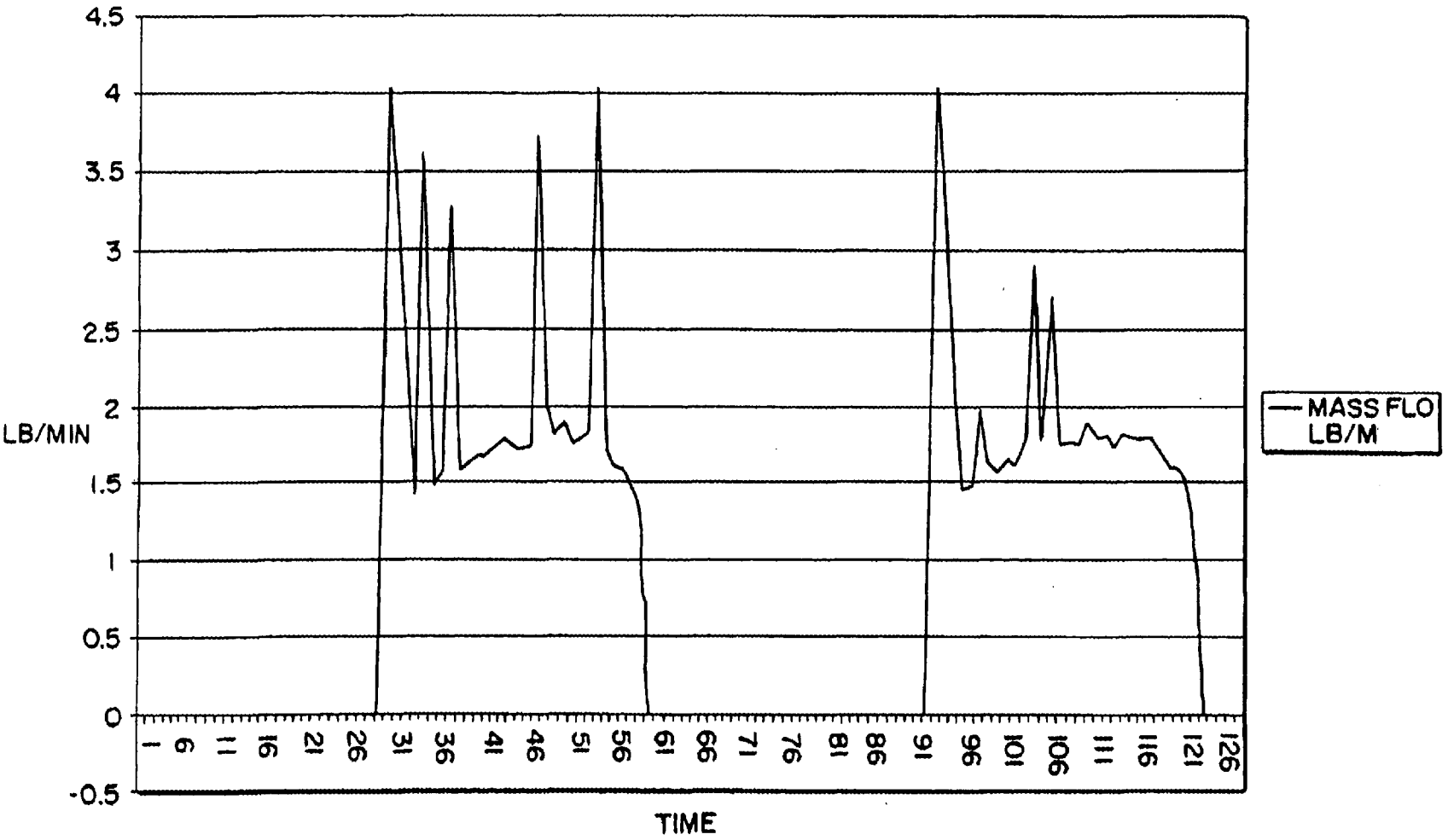
FIG. 8 is a data plot showing the mass flow rate of refrigerant feed at the inlet to the evaporator versus time during the same two cycles of operation shown in FIG. 5.
Figure 11:
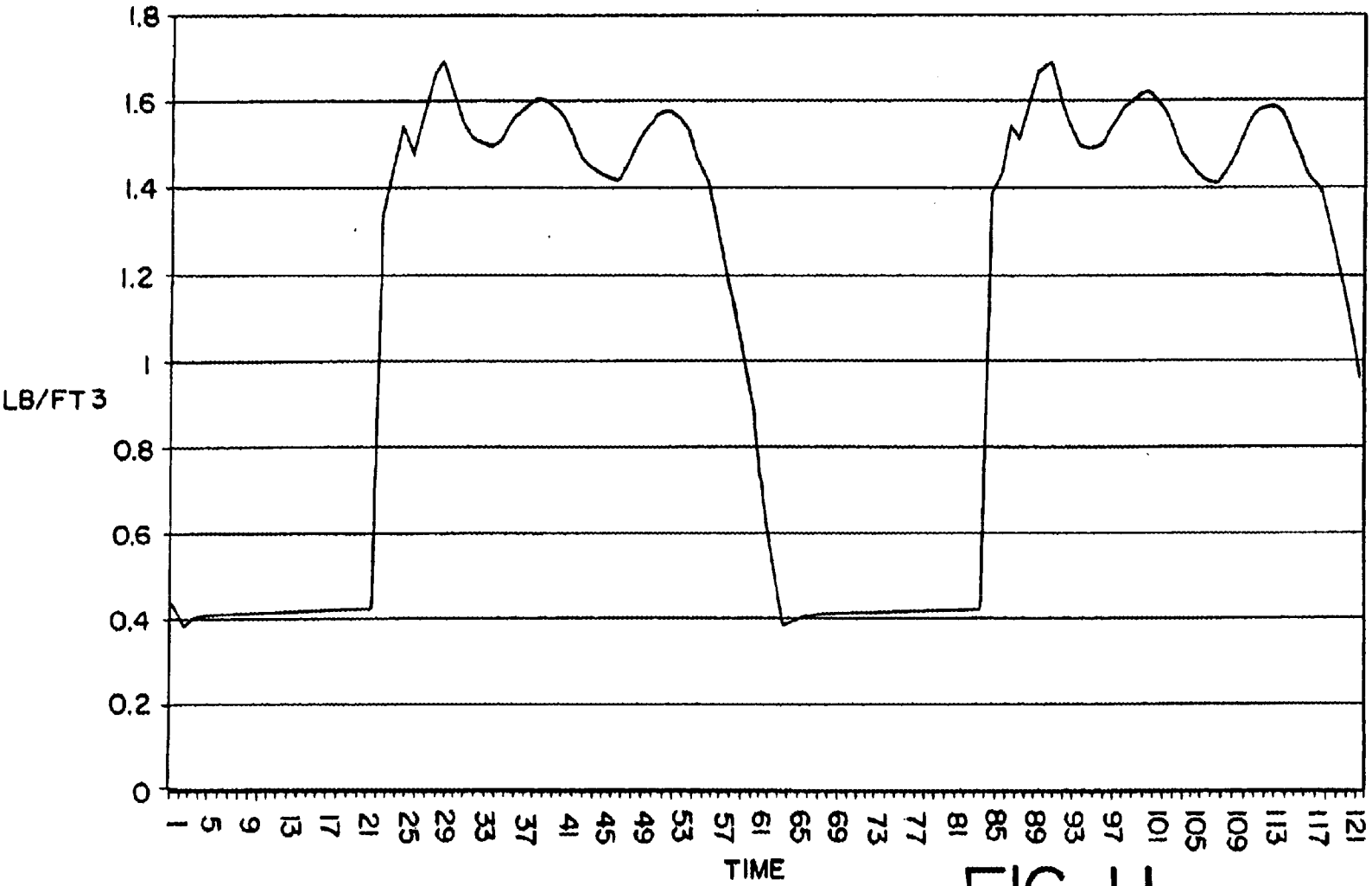
FIG. 11 is a data plot showing the density of refrigerant feed at the inlet to the evaporator versus time during the same two cycles of operation shown in FIG. 9.
Figure 12:
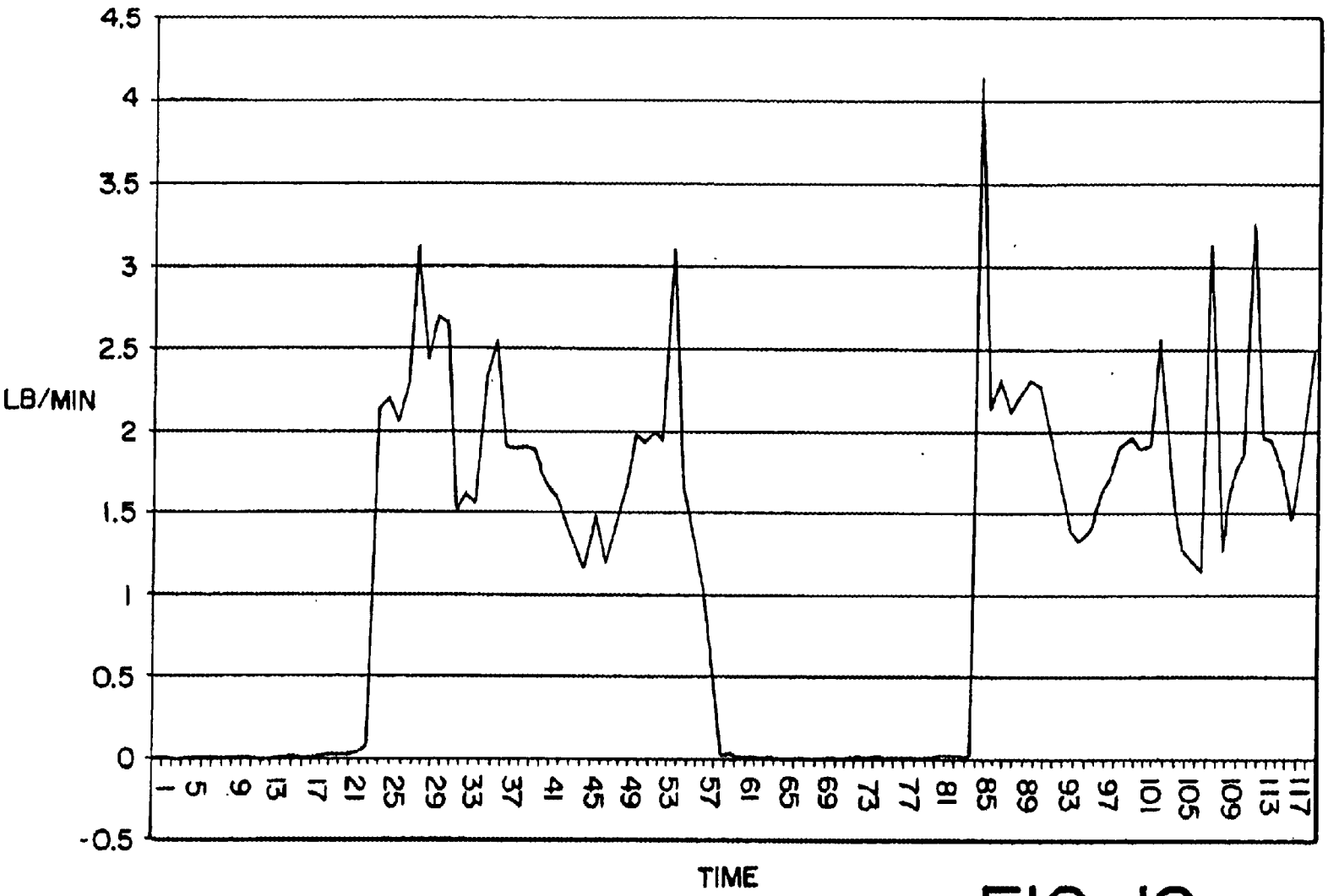
FIG. 12 is a data plot showing mass flow rate of refrigerant at the inlet to the evaporator versus time during the same two cycles of operation shown in FIG. 9.

Tables D and E, shown below, are tabulations of the refrigerant flow rate data shown in FIGS. 6–8 (XDX) and FIGS. 10–12 (conventional) during the portions of the refrigeration cycles of each when the compressor was running. The data was collected using a vapor reading meter which, due to vapor/liquid make-up of the refrigerant feed, may not be quantitatively precise and hence the arithmetic averages values should not be construed as reflecting actual CFM or lbs/min. Nonetheless, it is believed that these values are reliable for the comparisons set forth in the conclusions immediately following these Tables.

TABLE D

| MEDIUM TEMPERATURE SYSTEM - XDX - EVAPORATOR INLET REFRIGERANT FLOW RATE | | | |
|---|---|---|---|
| TIME (SECONDS) | VOLUME (cfm) | DENSITY (lbs./ft$^3$) | MASS (lbs./min) |
| 0 | 4.20 | 0.96 | 4.04 |
| 5 | 3.68 | 0.92 | 3.38 |
| 10 | 1.81 | 1.16 | 2.10 |
| 15 | 1.09 | 1.30 | 1.41 |
| 20 | 2.59 | 1.39 | 3.59 |
| 25 | 1.07 | 1.43 | 1.52 |
| 30 | 1.07 | 1.47 | 1.56 |
| 35 | 2.18 | 1.51 | 3.29 |
| 40 | 1.03 | 1.55 | 1.60 |
| 45 | 1.01 | 1.61 | 1.61 |
| 50 | 1.03 | 1.65 | 1.70 |
| 55 | 1.01 | 1.68 | 1.69 |
| 60 | 1.03 | 1.68 | 1.73 |
| 65 | 1.07 | 1.69 | 1.80 |
| 70 | 1.05 | 1.69 | 1.77 |
| 75 | 1.03 | 1.69 | 1.74 |
| 80 | 1.03 | 1.70 | 1.75 |
| 85 | 2.20 | 1.70 | 3.75 |
| 90 | 1.19 | 1.70 | 2.03 |
| 95 | 1.06 | 1.71 | 1.80 |
| 100 | 1.12 | 1.71 | 1.91 |
| 105 | 1.04 | 1.70 | 1.76 |
| 110 | 1.06 | 1.70 | 1.80 |
| 115 | 1.08 | 1.69 | 1.82 |
| 120 | 2.42 | 1.67 | 4.03 |
| 125 | 1.06 | 1.62 | 1.71 |
| 130 | 1.04 | 1.55 | 1.61 |
| 135 | 1.10 | 1.46 | 1.60 |

TABLE D-continued

| MEDIUM TEMPERATURE SYSTEM - XDX - EVAPORATOR INLET REFRIGERANT FLOW RATE | | | |
|---|---|---|---|
| TIME (SECONDS) | VOLUME (cfm) | DENSITY (lbs./ft$^3$) | MASS (lbs./min) |
| 140 | 1.08 | 1.39 | 1.49 |
| 145 | 0.97 | 1.29 | 1.25 |
| Arithmetic Average | 1.45 | 1.54 | 2.10 |
| StandardDeviation | 0.82 | 0.22 | 0.83 |
| Arithmetic Mean | 1.45 | 1.53 | 2.09 |
| Median | 1.07 | 1.64 | 1.75 |

TABLE E

| MEDIUM TEMPERATURE SYSTEM - CONVENTIONAL - EVAPORATOR INLET REFRIGERANT FLOW RATE | | | |
|---|---|---|---|
| TIME (SECONDS) | VOLUME (cfm) | DENSITY (lbs./ft$^3$) | MASS (lbs./min) |
| 0 | 1.46 | 1.46 | 2.13 |
| 5 | 1.44 | 1.54 | 2.21 |
| 10 | 1.40 | 1.48 | 2.06 |
| 15 | 1.46 | 1.56 | 2.28 |
| 20 | 1.89 | 1.65 | 3.11 |
| 25 | 1.44 | 1.69 | 2.43 |
| 30 | 1.66 | 1.62 | 2.70 |
| 35 | 1.70 | 1.56 | 2.66 |
| 40 | 1.00 | 1.51 | 1.52 |
| 45 | 1.09 | 1.50 | 1.63 |
| 50 | 1.04 | 1.49 | 1.56 |
| 55 | 1.54 | 1.51 | 2.33 |
| 60 | 1.64 | 1.55 | 2.55 |
| 65 | 1.21 | 1.57 | 1.90 |
| 70 | 1.19 | 1.59 | 1.89 |
| 75 | 1.19 | 1.60 | 1.90 |
| 80 | 1.18 | 1.59 | 1.89 |
| 85 | 1.08 | 1.57 | 1.69 |
| 90 | 1.06 | 1.54 | 1.62 |
| 95 | 0.97 | 1.48 | 1.44 |
| 100 | 0.89 | 1.45 | 1.29 |
| 105 | 0.81 | 1.43 | 1.16 |
| 110 | 1.06 | 1.42 | 1.50 |
| 115 | 0.85 | 1.41 | 1.20 |
| 120 | 0.95 | 1.45 | 1.38 |
| 125 | 1.08 | 1.51 | 1.63 |
| 130 | 1.28 | 1.55 | 1.99 |
| 135 | 1.22 | 1.57 | 1.92 |
| 140 | 1.26 | 1.58 | 1.99 |
| 145 | 1.25 | 1.57 | 1.96 |
| 150 | 2.03 | 1.52 | 3.10 |
| 155 | 1.14 | 1.46 | 1.67 |
| 160 | 0.96 | 1.42 | 1.37 |
| 165 | 0.82 | 1.32 | 1.08 |
| 170 | 0.43 | 1.19 | 0.51 |
| Arithmetic Average | 1.23 | 1.52 | 1.88 |
| StandardDeviation | 0.33 | 0.09 | 0.56 |
| Arithmetic Mean | 1.22 | 1.51 | 1.86 |
| Median | 1.19 | 1.52 | 1.89 |

These data show that in a given refrigeration cycle, the compressor in the XDX system of the present invention was pumping for approximately 145 seconds while in the conventional system it was pumping for 170 seconds (approximately 17.2% longer). Accordingly, power requirements for the XDX system in a given refrigeration cycle are significantly less than the power requirements for a conventional vapor compression refrigeration system handling the same cooling load.

Correspondingly, as demonstrated by a comparison of the volumetric inlet flow rates for the XDX and conventional systems, the XDX volumetric flow rate at the inlet to the evaporator was approximately 18% and the XDX mass flow rate was approximately 11% greater than that of the conventional system. Moreover, the more consistent volume, density and mass data for the conventional system as compared to the XDX system (demonstrated by the lower standard deviation calculations) suggests greater consistency in the make-up of the refrigerant feed and a higher liquid content for the feed in the conventional system than the XDX system. As such, these data confirm that in the XDX system, the refrigerant feed to the evaporator inlet is characterized by a higher vapor to liquid ratio than the inlet refrigerant feed to the evaporator in a conventional vapor compression refrigeration system operating under the same cooling load requirements and with identical condenser, evaporator and compressor components.

Additionally, data collected at the outlet of the evaporator in Example III were consistent with volumetric and mass flow rates at the inlet (i.e. the XDX system volumetric and mass flow rates were respectively approximately 18% and 11% greater than the volumetric and mass flow rates of the conventional system) confirmed that the refrigerant discharge from the evaporator in the XDX mode contained some liquid while the refrigerant discharge from the evaporator in the conventional mode was entirely vapor. The amount of liquid in the XDX mode evaporator discharge, however, was sufficiently small so that the feed to the compressor was entirely vapor. Accordingly, in the XDX mode, the latent heat of vaporization was utilized along the entire coil while a significant portion of the evaporator coil in the conventional mode did not utilize the refrigerant's latent heat of evaporation. As these data show, the evaporator coil in an XDX system is more efficient along the entire refrigerant path in the evaporator while in the comparable conventional system it is less efficient at least at those portions of the coil adjacent the inlet and outlet of the evaporator.

EXAMPLE IV

This Example compares the performance of a vapor compression refrigeration system of the present invention (the XDX system) with that of a conventional system operating in the low temperature range.

The refrigeration circuit of a four door IFI freezer (Model EPG-4) was equipped with a multifunctional device as described herein (which included a Sporlan Q-body thermostatic expansion valve). A like thermostatic expansion valve was plumbed into a bypass line so that the refrigeration circuit could be operated either as an XDX refrigeration system or a conventional refrigeration system.

This refrigeration circuit included an evaporator feed line (in the XDX mode) having an outside tube diameter of 0.5 in. (1.27 cm) and a run length from the compressorized unit (the assembly of the compressor, condenser and receiver) to the evaporator of approximately 20 ft. (6.10 m) was the same for both the XD and conventional modes. The liquid feed line (in the conventional mode) had an outside tube diameter of 0.375 in. (0.95 cm) and approximately the same run length. Both modes of operation used the same condenser evaporator and suction line which had an outside diameter of 0.875 in. (2.22 cm). In both modes of operation, the refrigeration circuit was powered by a Bitzer Model 2CL-4.2Y compressor.

A sensing bulb was attached to the suction line about two feet (0.61 m) from the compressor in the XDX mode and was coupled to the multifunction device as described above with respect to FIG. 1. The thermostatic expansion valve component of the multifunctional device was set at 15° F. (8.3° C.) superheat.

In the conventional mode, the thermostatic expansion valve was located adjacent the inlet to the evaporator and the sensor adjacent the evaporator outlet. The valve was set to open when the superheat measured by the sensor was above 2° F. (1.1° C.).

In both modes of operation, the circuits were charged with like amounts of AZ-50 refrigerant and the operating temperature range in the freezer was from −15° F. (−26.1° C.) to −20° F. (−28.9° C.). Data measurements were made with a Sponsler Company (Westminster, S.C.) flow meter (Model IT-300N) and flow meter adapted (Model SP1-CB-PH7-A-4X) and a Logic Beach, Inc. (La Mesa, Calif.) Hyperlogger recorder (Model HL1).

Figure 13:
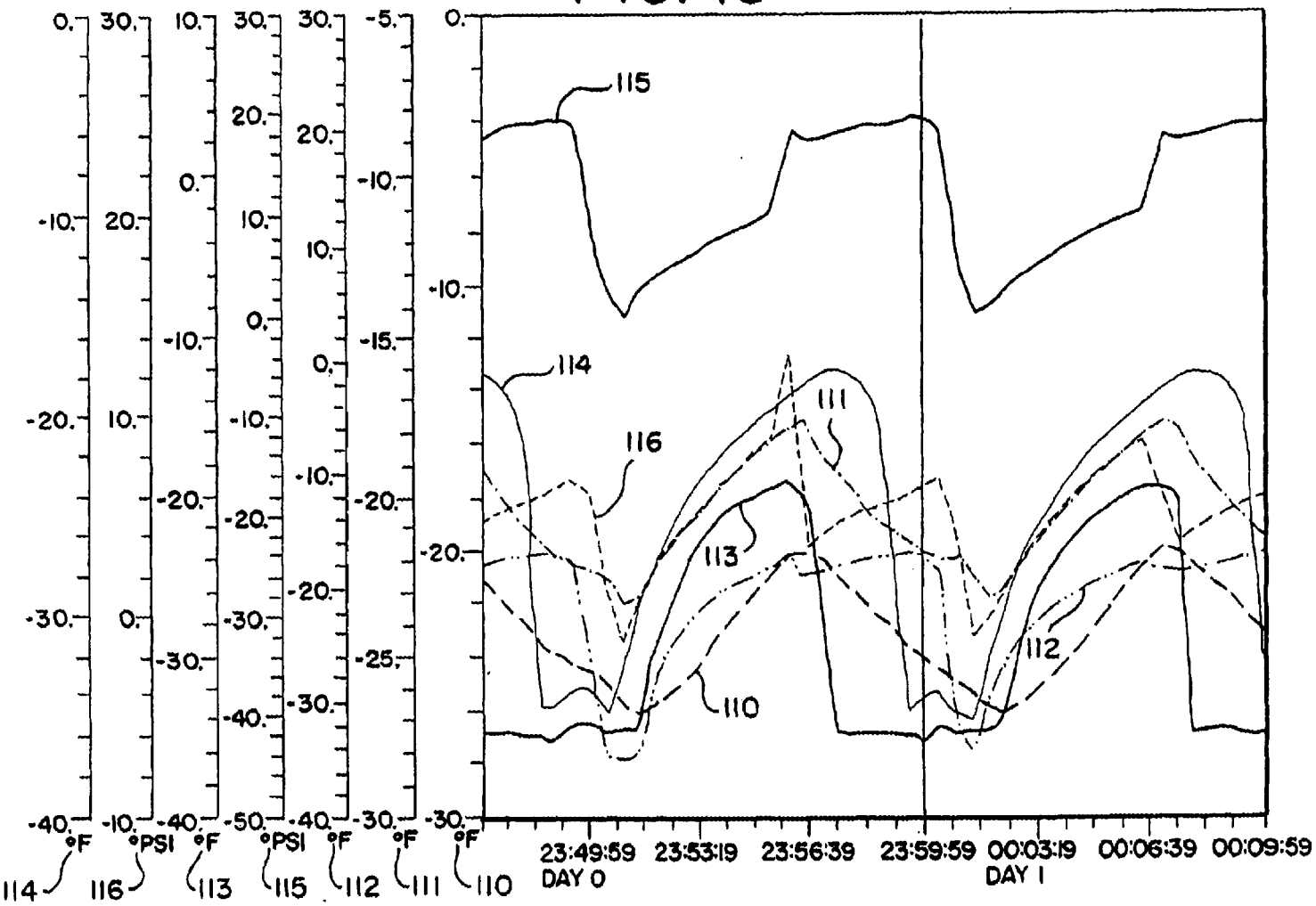
FIG. 13 is a data plot showing the pressure and temperature of refrigerant at various locations along the cooling coil of the evaporator as well as the supply air temperature and return air temperature versus time during two cycles of operation of a low temperature vapor compression refrigeration system embodying the present invention.

FIG. 13 shows data collected over approximately two cycles of operation for the XDX system of this Example. In particular, it shows in degrees Fahrenheit the supply air temperature (110), the return air temperature (111), the temperature of refrigerant at the evaporator inlet (112), the evaporator center (113) and evaporator outlet (114) and the pressures (psi) of the refrigerant at the evaporator inlet (115) and evaporator center (116).

Figure 15:
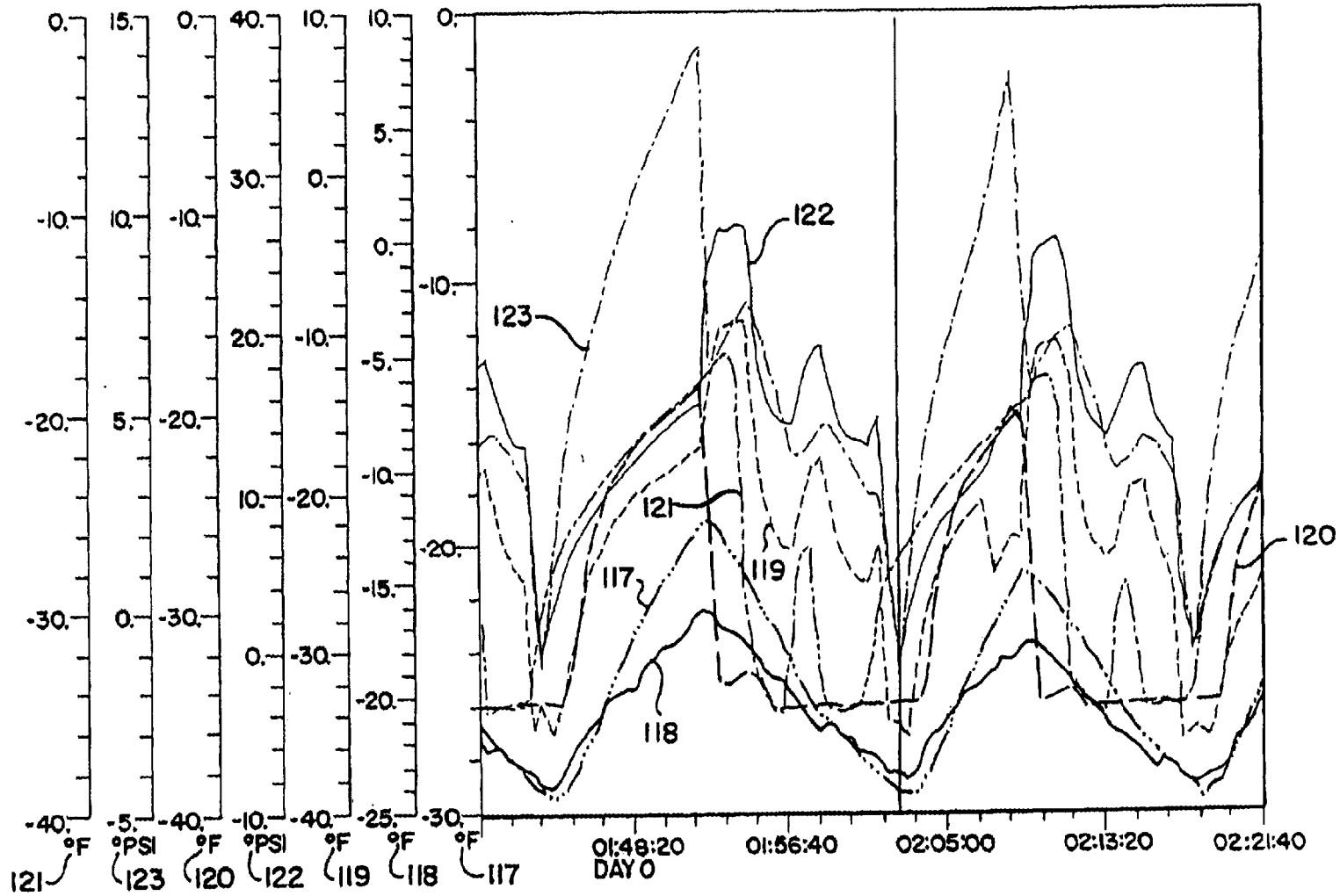
FIG. 15 is a data plot showing the pressure and temperature refrigerant at various locations along the cooling coil of the evaporator as well as the supply air temperature and return air temperature versus time during two cycles of operation of a conventional low temperature vapor compression refrigeration system.

Correspondingly, FIG. 15 shows data collected over a like number of cycles of operation for the conventional vapor pressure refrigeration system of this Example. In particular, it shows temperatures in degrees Fahrenheit of the supply air (117), return air (118), refrigerant at the evaporator inlet (119), refrigerant at evaporator center (120) and evaporator outlet (121). The refrigerant pressure (psi) at the evaporator inlet (122) and evaporator center (123) is also shown.

Tables F through I provide a comparison of the data shown in FIGS. 13 and 15 at comparable times in the refrigeration cycles of each of the XDX system and the conventional system.

TABLE F

COMPARISON OF EVAPORATOR COIL TEMPERATURES AND PRESSURES AND SUPPLY/RETURN AIR TEMPERATURES FOR XDX AND CONVENTIONAL LOW TEMPERATURE SYSTEMS (30 SECONDS INTO REFRIGERATION MODE PART OF CYCLE)

| | XDX | CONVENTIONAL |
|---|---|---|
| Supply Air (° F.) | −19.9668 | −19.0645 |
| Return Air (° F.) | −17.5977 | −16.1275 |
| Evaporator Coil Inlet Temperature (° F.) | −18.6792 | −13.4482 |
| Evaporator Coil Inlet Pressure (psi) | 17.9121 | 24.5381 |
| Evaporator Coil Center Temperature (° F.) | −19.9404 | −23.2656 |
| Evaporator Coil Center Pressure (psi) | 3.51526 | 6.42481 |
| Evaporator Coil Outlet Temperature (° F.) | −18.1885 | −17.9038 |

The data shown in Table F was taken 30 seconds after the respective compressor in the XDX and conventional refrigeration systems began pumping. As shown, the temperature differential along the refrigerant path in the evaporator is significantly greater for the conventional system than for the XDX. In particular, this temperature differential for XDX is +0.49° F. while for the conventional system it was −4.45° F. Accordingly, at this point in the operating cycles of each of these systems, the advantageous uniformity of temperature achievable with XDX is readily demonstrated. Similarly, in the XDX system, the temperature differential between the supply air and return air is approximately 2.37° F. while the temperature differential between the supply air and return air with the conventional system is approximately 2.94° F. Correspondingly, the temperature differential between the cooling coils and air circulated in the evaporator is significantly lower for the XDX system than with the conventional system. For example, the difference between the return air temperature and the evaporator coil outlet is approximately 0.59° F. with the XDX system and approximately 1.8° F. with the conventional system. Similarly, the temperature differential between the evaporator coil inlet and supply air for the XDX system is approximately 1.29° F. while the corresponding temperature differential for the conventional system is approximately 5.6° F.

TABLE G

COMPARISON OF EVAPORATOR COIL TEMPERATURES AND PRESSURES AND SUPPLY/RETURN AIR TEMPERATURES FOR XDX AND CONVENTIONAL LOW TEMPERATURE SYSTEMS (30 SECONDS BEFORE END OF REFRIGERATION MODE PART OF CYCLE)

| | XDX | CONVENTIONAL |
|---|---|---|
| Supply Air (° F.) | −24.0112 | −28.1548 |
| Return Air (° F.) | −21.6411 | −22.4385 |
| Evaporator Coil Inlet Temperature (° F.) | −16.9004 | −25.6831 |
| Evaporator Coil Inlet Pressure (psi) | 19.437 | 12.8137 |
| Evaporator Coil Center Temperature (° F.) | −35.0381 | −34.6953 |
| Evaporator Coil Center Pressure (psi) | 6.60681 | 2.92621 |
| Evaporator Coil Outlet Temperature (° F.) | −34.0586 | −32.9444 |

As the above data show, 30 seconds before the end of the refrigeration mode (prior to when the compressor stopped pumping), the differential temperature between the supply air and return air is significantly less for the XDX system then it is for the conventional system. In particular, the differential temperature between the supply air and return air with XDX at this point in the cycle is approximately 2.4° F. whereas with the conventional system this temperature differential is approximately 5.7° F. Furthermore, since the same evaporator was utilized for the XDX and conventional systems, the larger pressure drop (inlet to center) for the XDX system (approximately 13 psi) as compared to the conventional systems (approximately 10 psi) indicates that with the XDX system the amount of vapor in the liquid/vapor refrigerant mixture is greater than with the conventional system.

TABLE H

COMPARISON OF EVAPORATOR COIL TEMPERATURES AND PRESSURES AND SUPPLY/RETURN AIR TEMPERATURES FOR XDX AND CONVENTIONAL LOW TEMPERATURE SYSTEMS (END OF REFRIGERATION MODE PART OF CYCLE)

| | XDX | CONVENTIONAL |
|---|---|---|
| Supply Air (° F.) | −25.5801 | −29.1123 |
| Return Air (° F.) | −22.4902 | −23.0835 |
| Evaporator Coil Inlet Temperature (° F.) | −34.2832 | −34.2647 |
| Evaporator Coil Inlet Pressure (psi) | 0.608826 | 0.062985 |
| Evaporator Coil Center Temperature (° F.) | −34.6592 | −34.6074 |

TABLE H-continued

| COMPARISON OF EVAPORATOR COIL TEMPERATURES AND PRESSURES AND SUPPLY/RETURN AIR TEMPERATURES FOR XDX AND CONVENTIONAL LOW TEMPERATURE SYSTEMS (END OF REFRIGERATION MODE PART OF CYCLE) | | |
|---|---|---|
| | XDX | CONVENTIONAL |
| Evaporator Coil Center Pressure (psi) | −0.947449 | −1.5661 |
| Evaporator Coil Outlet Temperature (° F.) | −35.2256 | −27.6992 |

The data set forth above in Table H was taken in each of the XDX and conventional systems at the point when the temperature when the load was satisfied and the unit pumped down. As these data show, there is significantly greater temperature uniformity along the cooling coil in the evaporator in the XDX system than in the conventional system. In particular, the temperature differential between the inlet and outlet of the evaporator coil with XDX was −0.95° F. while the temperature differential at corresponding locations in the conventional system was +6.57° F. Similarly, the temperature differential between the supply air and return air in the XDX system was approximately 3.1° F. while the differential between the supply air and return air temperature in the conventional system was approximately 6.03° F.

TABLE I

| COMPARISON OF EVAPORATOR COIL TEMPERATURES AND PRESSURES AND SUPPLY/RETURN AIR TEMPERATURES FOR XDX AND CONVENTIONAL LOW TEMPERATURE SYSTEMS START OF REFRIGERATION MODE PART OF CYCLE) | | |
|---|---|---|
| | XDX | CONVENTIONAL |
| Supply Air (° F.) | −20.4819 | −21.8208 |
| Return Air (° F.) | −18.0098 | −18.3189 |
| Evaporator Coil Inlet Temperature (° F.) | −17.7007 | −22.8506 |
| Evaporator Coil Inlet Pressure (psi) | 10.4963 | 15.2344 |
| Evaporator Coil Center Temperature (° F.) | −19.3223 | −20.353 |
| Evaporator Coil Center Pressure (psi) | 9.02857 | 13.5627 |
| Evaporator Coil Outlet Temperature (° F.) | −19.5283 | −20.0435 |

These data were taken at the point at which the temperature at the load warmed to the point causing the solenoid to open causing the compressor to begin pumping.

As shown above, the XDX system shows greater uniformity of temperature along the entire cooling coil than does the conventional system. In particular, the XDX system shows a temperature differential of −1.83° F. while the temperature differential between the evaporator coil inlet and outlet for the conventional system was approximately +2.81° F. The XDX system also showed a smaller temperature differential between the return air and supply air with XDX, this differential being 2.47° F. whereas the conventional system showed a 3.57° F. temperature differential. Also, the temperature of the refrigerant fluid at the outlet in the conventional system indicates supersaturation of the refrigerant fluid at the outlet and hence that this fluid was in an all-vapor condition.

Additionally, for example, the temperature at the XDX evaporation coil inlet is warmer (−17.7° F.) than the temperature of the return air (−18.0° F.) and the temperature of the supply air (−20.5° F.). Accordingly, not only will humidity from the conditioned be deposited onto the evaporator coil at this location (where build-up of frost commonly occurs in conventional systems) but also any moisture which may have been previously deposited during other portions of the operating cycle will be vaporized and returned back to the conditioned air. This feature of the XDX system enables operation of refrigeration/freezer over extended periods of time with substantially reduced needs for defrosting.

Figure 14:
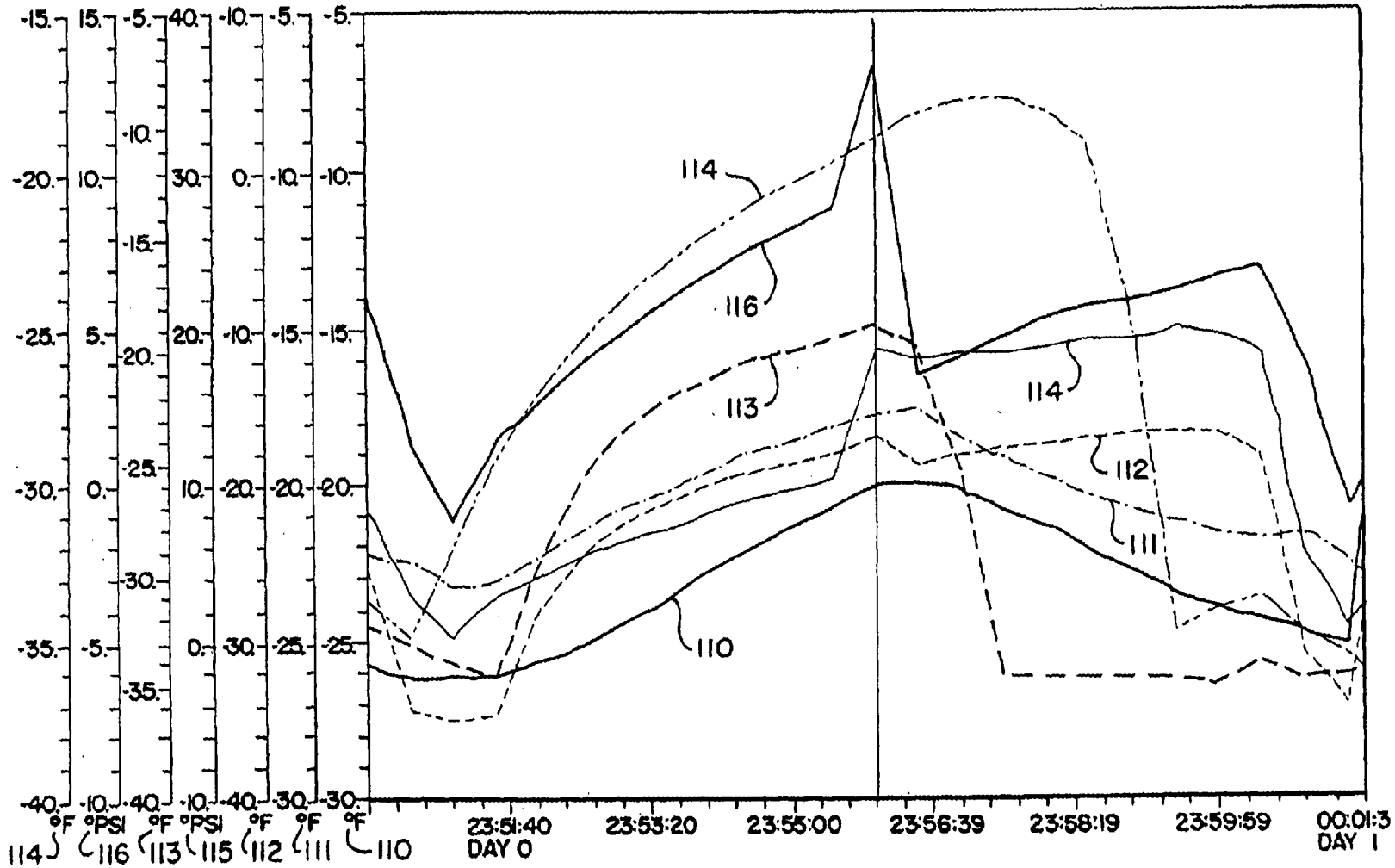
FIG. 14 is a data plot showing the pressure and temperature of refrigerant along the cooling coil in the evaporator as well as the supply air temperature and return air temperature versus time during a single cycle of operation of a low temperature vapor compression refrigeration system embodying the present invention.
Figure 16:
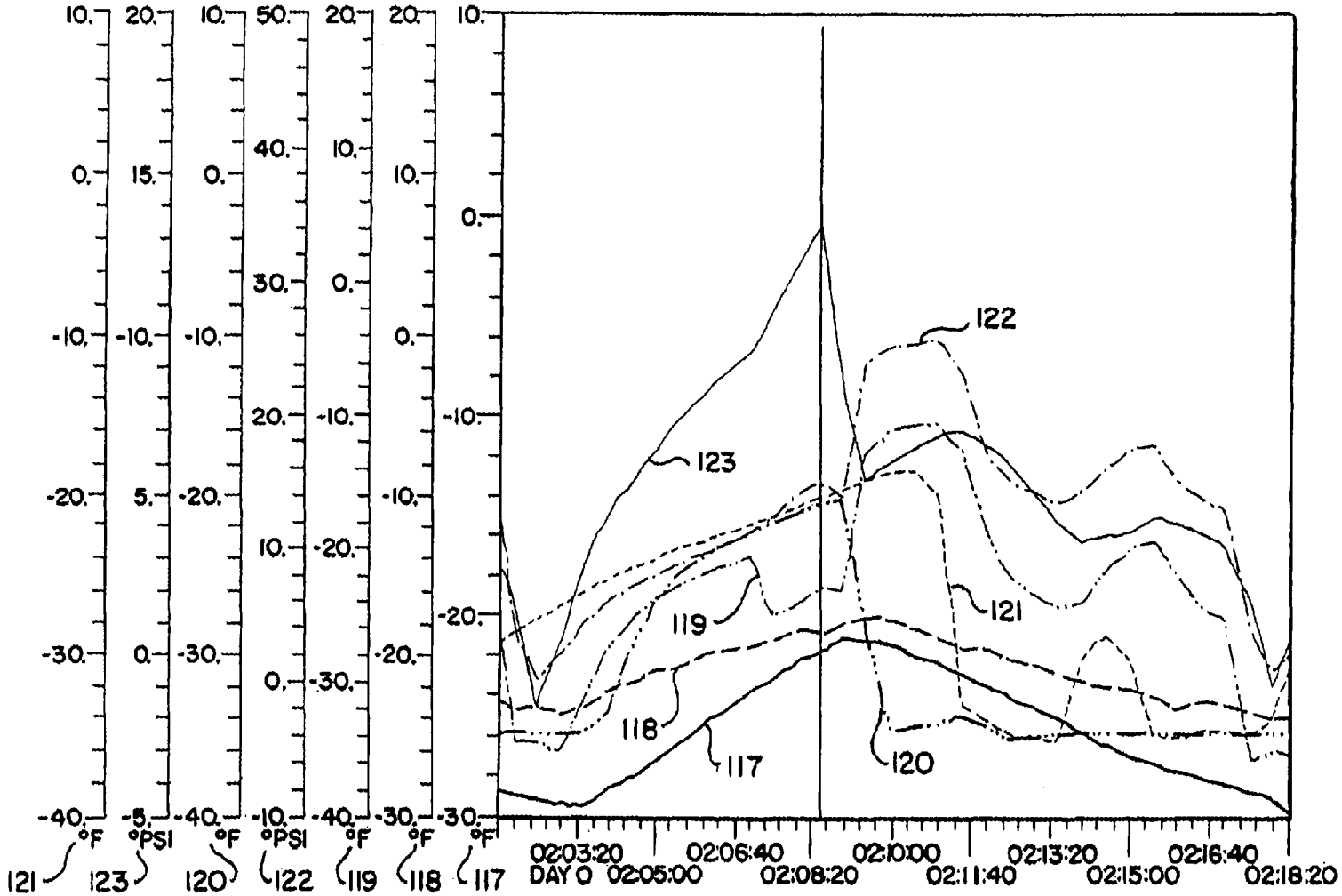
FIG. 16 is a data plot showing the pressure and temperature refrigerant at various locations along the cooling coil of the evaporator as well as the supply air temperature and return air temperature versus time during a single cycle of operation of a conventional low temperature vapor compression refrigeration system.

FIG. 14 shows data collected over a single operating cycle for XDX system of this Example. As was the case with FIG. 13, supply and return air temperatures are designated by the reference numerals 110 and 111, temperatures of the refrigerant at the evaporator inlet, center and outlet are designated by reference numerals 112, 113 and 114 and the pressure of the refrigerant at the evaporator inlet and center are designated by reference numerals 115 and 116. Correspondingly, FIG. 16 shows data collected over a single cycle of operation for the conventional vapor pressure refrigeration system of this Example. Temperature measurements of the supply air and return air are identified by reference numerals 117 and 118, temperatures of the refrigerant at the evaporator inlet by reference numeral 119, at the evaporator center by reference numeral 120 and at the evaporator outlet by reference numeral 121. Refrigerant pressure (psi) at the evaporator inlet (122) and evaporator (123) is also shown. In this regard, it will be noted that the full cycle of operation for the XDX system took 11 minutes and 39 seconds whereas the full cycle of operation for the conventional system took 16 minutes and 40 seconds. This significantly reduced cycle time is the further confirmation of the improved efficiency of the XDX system of the present invention as compared to conventional vapor compression refrigeration systems. A comparison of the data shown in FIGS. 14 and 16 as shown in Table J set forth below.

TABLE J

| COMPARISON OF OVERALL FULL CYCLE EVAPORATOR COIL TEMPERATURES AND PRESSURES FOR XDX AND CONVENTIONAL LOW TEMPERATURE SYSTEMS | | | | | | |
|---|---|---|---|---|---|---|
| | CONVENTIONAL | | | XDX | | |
| | AVERAGE | MINIMUM | MAXIMUM | AVERAGE | MINIMUM | MAXIMUM |
| Supply Air (° F.) | −23.2 | −26.1 | −20 | −25.5 | −29 | −21 |
| Return Air (° F.) | −20.6 | −23.3 | −17.6 | −20.8 | −23.8 | −17.6 |
| Evaporator Coil Inlet Temperature (° F.) | −22.6 | −35.1 | −16.9 | −23 | −35.5 | −10.5 |
| Evaporator Coil Inlet Pressure (psi) | +11 | +.02 | +19.7 | +12.95 | +0.6 | +25.8 |
| Evaporator Coil Center Temperature (° F.) | −29 | −35.8 | −18.9 | −30.8 | −34.9 | −20 |
| Evaporator Coil Center Pressure (psi) | +5.1 | −1.2 | +13.3 | +5.5 | −1.56 | +13.6 |
| Evaporator Coil Outlet Temperature (° F.) | −25.8 | −35 | −17.8 | −27 | −35 | −18 |

As the data in Table J show, the average temperature differential between the evaporator inlet and outlet for the XDX system in this Example was −3.2° F. while the temperature differential for the conventional system was −4° F. Correspondingly, the average temperature differential between the supply air and return air in the XDX system was 2.6° F. whereas with the conventional system it was 4.7° F.

EXAMPLE V

This Example illustrates the performance of a vapor compression refrigeration system of the present invention (the XDX system) operating in the low temperature range and, among other things, shows temperature and pressure measurements of the refrigerant at the inlet, center and outlet of the evaporator through two complete operating cycles.

The refrigeration circuit of a five door IFI freeze (Model EFG-5) was equipped with a multifunctional device as described herein (which included a Sporlan Q-body thermostatic expansion valve). This refrigeration circuit included an evaporator feed line having an outside tube diameter of 0.5 in. (1.27 cm) and a run length (compressor to evaporator) of approximately 20 ft. (6.10 m) and a suction line which had an outside diameter of 0.875 in. (2.22 cm). A Bitzer Model 2Q-4.2Y compressor powered the refrigeration circuit.

A sensing bulb was attached to the suction line about two feet (0.61 m) from the compressor in the XDX mode and was coupled to the multifunction device as described above with respect to FIG. 1. The thermostatic expansion valve component of the multifunctional device was set at 15° F. (8.3° C.) superheat. The circuit was charged with AZ-50 refrigerant and the operating temperature range in the freezer was from −15° F. (−26.1° C.) to −20° F. (−28.9° C.).

Figure 17:
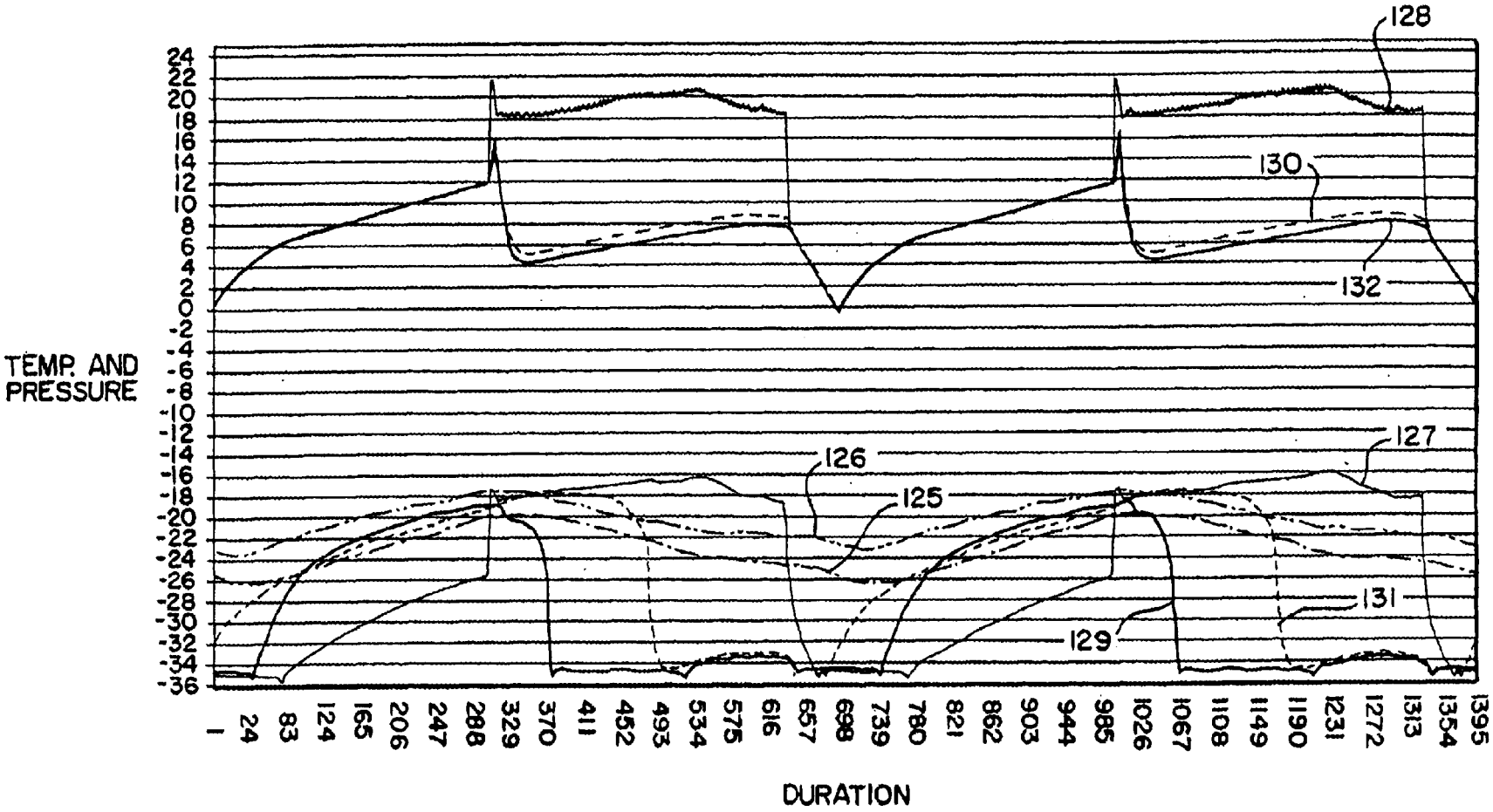
FIG. 17 is a data plot showing the pressure and temperature of refrigerant at the inlet, center and outlet of the cooling coil in the evaporator as well as the supply air temperature and return air temperature versus time during two cycles of operation of a low temperature vapor compression refrigeration system in accordance with a further embodiment of the present invention.
Figure 18:
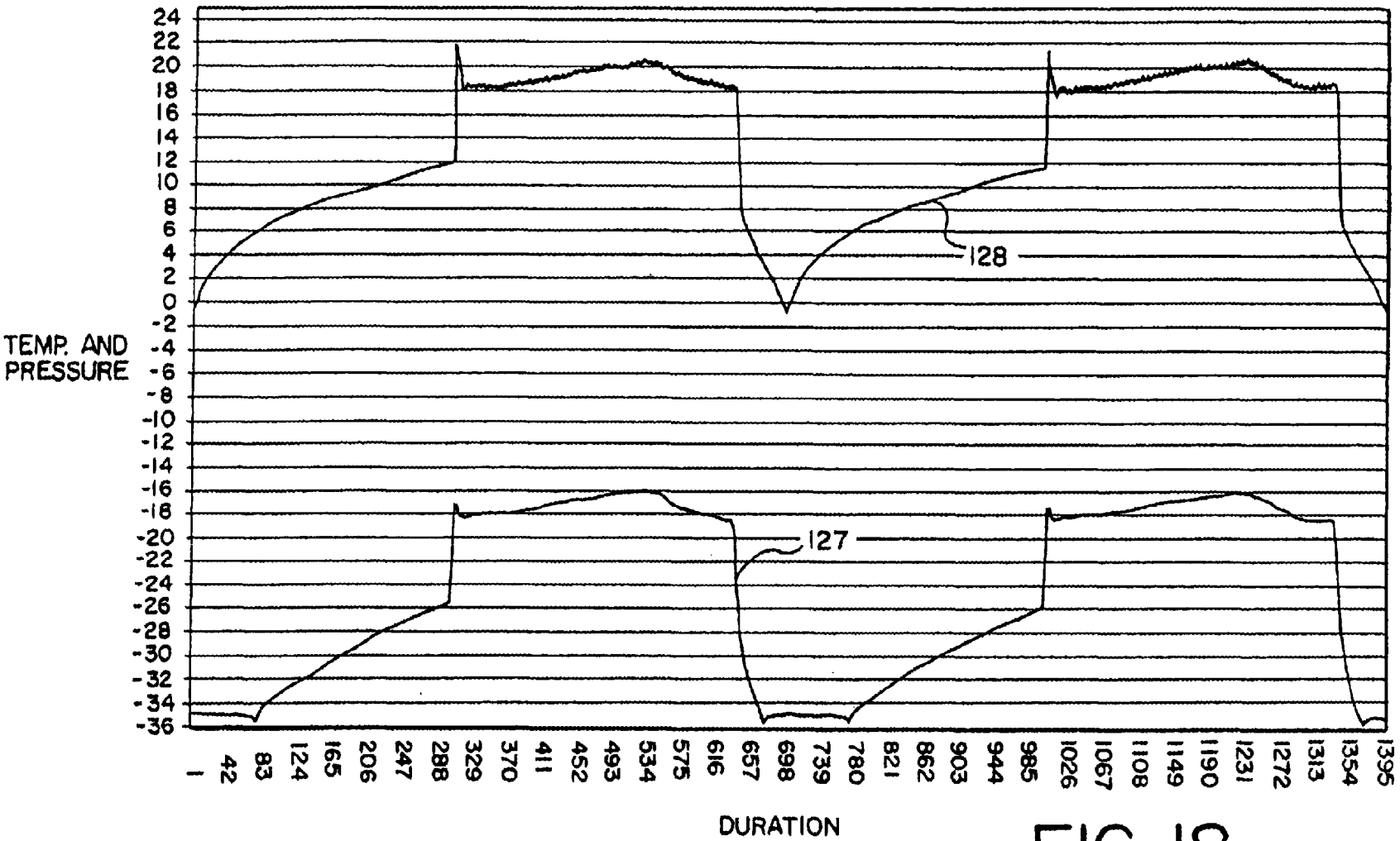
FIG. 18 is a data plot showing the temperature and pressure of the refrigerant feed at the inlet of the evaporator during the same two cycles of operation shown in FIG. 17.
Figure 19:
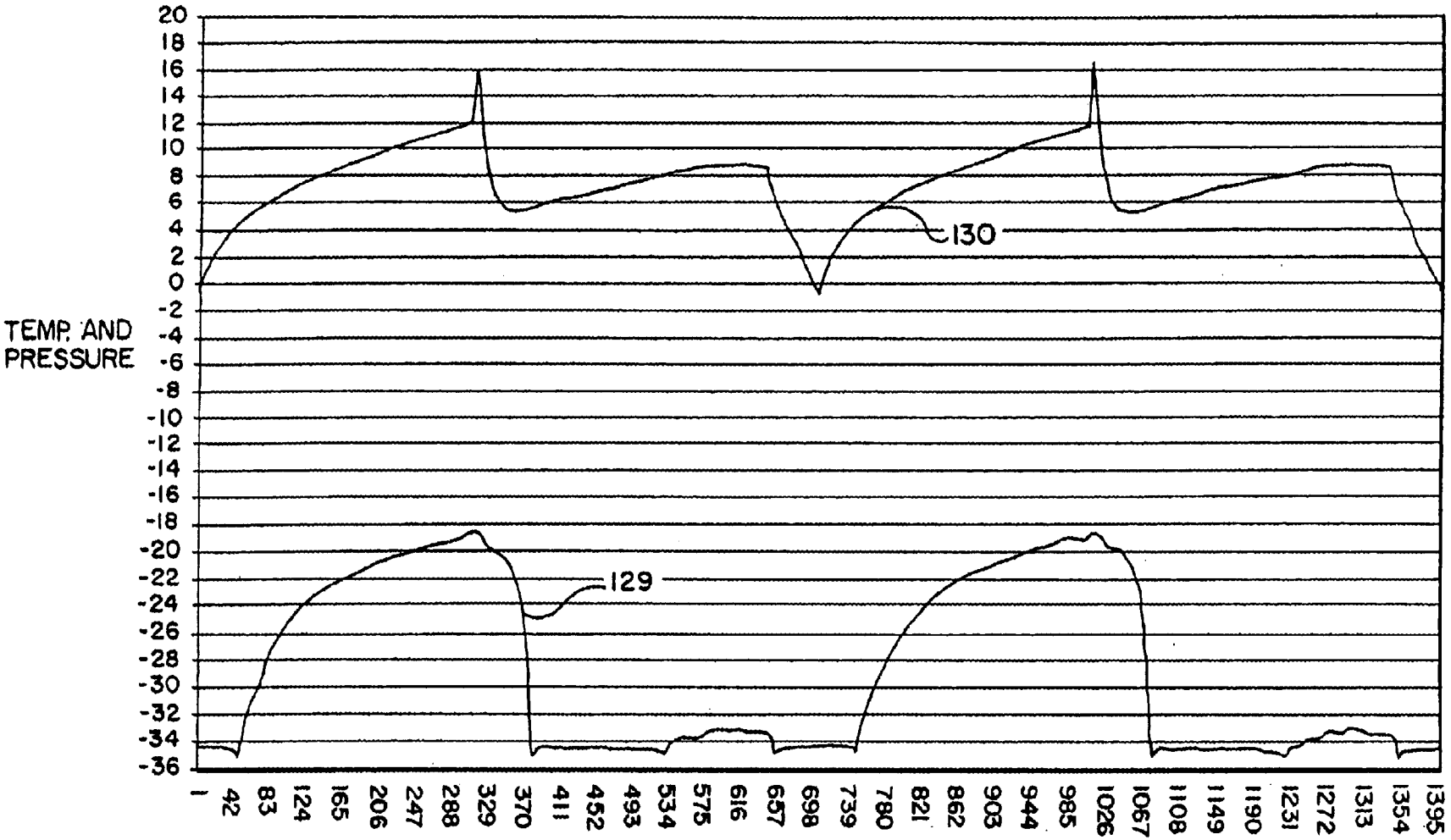
FIG. 19 is a data plot showing the pressure and temperature of the refrigerant at the center of the cooling coil of the evaporator shown in FIG. 17.
Figure 20:
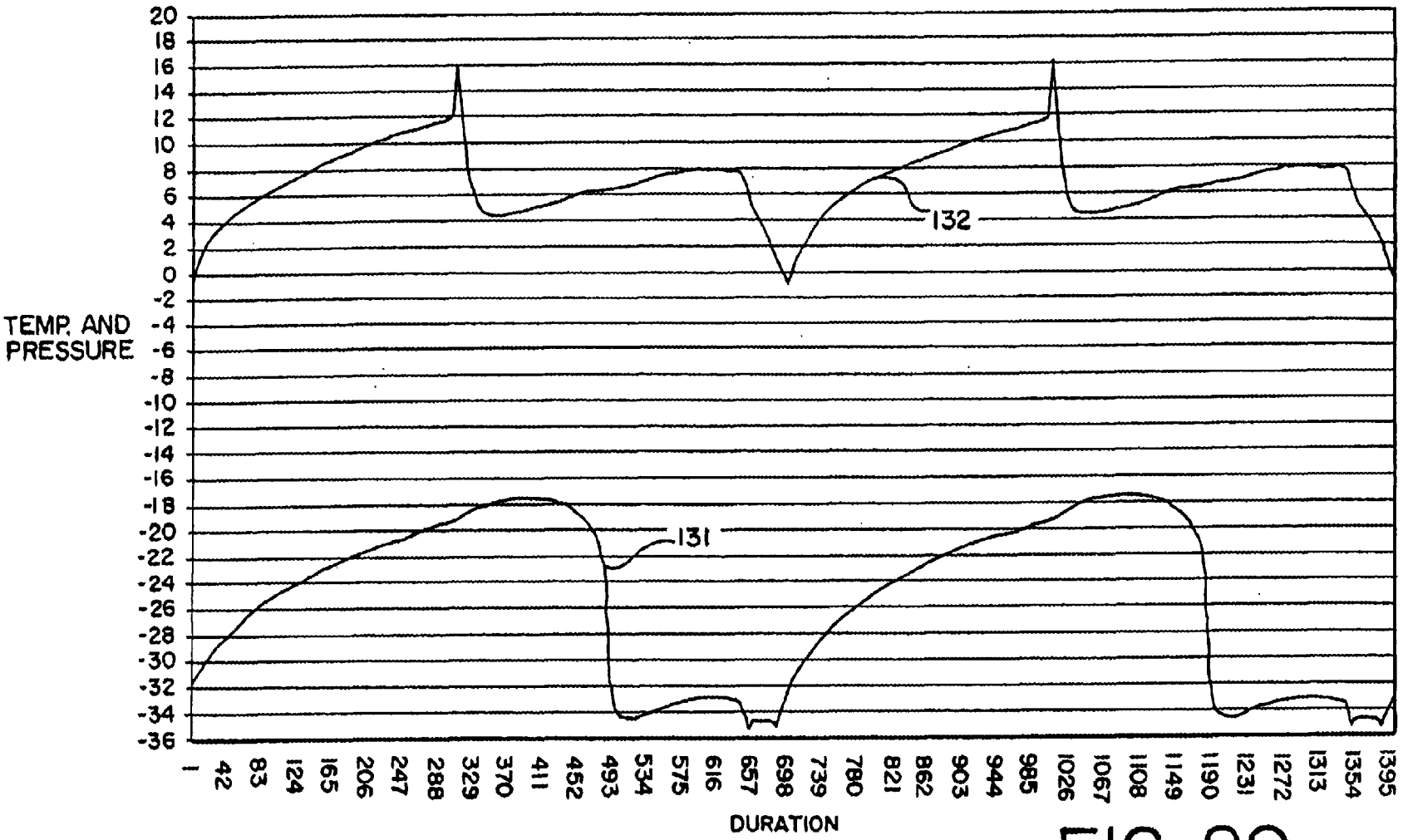
FIG. 20 is a data plot showing the pressure and temperature of the refrigerant at the outlets of the cooling coil in the evaporator during the same two cycles of operation shown in FIG. 17.

FIGS. 17–19 show refrigerant data collected at the inlet, center and outlet of the evaporator over two representative consecutive operating cycles. In FIG. 17, pressure (psi) and the temperature (°F.) of the refrigerant at the inlet to the evaporator are designated by reference numerals 128 and 127, respectively. The corresponding supply air temperature (°F.) and return air temperature (°F.) are likewise respectively designated by reference numerals 125 and 126. In FIGS. 18, 19 and 20 the refrigerant temperature and pressure at the inlet, center and outlet of the evaporator are shown over the same two operating cycles.

A comparison of the pressure and temperature readings, at any given point in time to phase diagram data for this refrigerant indicates whether the refrigerant is in a liquid, a vapor or liquid/vapor mixture state. Such a comparison shows that with XDX system, the refrigerant in the entire cooling coil is in the form of a liquid and vapor mixture for a significant and effective portion of operating cycle when the compressor is running. By contrast, in conventional systems, there is no portion of the operating cycle when the compressor is running that a mixture of refrigerant liquid and vapor is simultaneously present at the inlet, center and outlet of the cooling coil. These data therefore confirm that latent heat of vaporization is effectively being utilized along the entire refrigerant path in the evaporator when the compressor is working.

EXAMPLE VI

This Example illustrates the frost-free operation vapor compression refrigeration systems (medium and low temperature) of the present invention (the XDX system) over extensive periods of time without requiring a defrost cycle.

Low Temperature System

In the low temperature system, the refrigeration circuit of a five door IFI freezer (Model EFG-5) was equipped with a multifunctional device as described herein (which included a Sporlan Q-body thermostatic expansion valve). The evaporator feed line had an outside tube diameter of 0.5 in. (1.27 cm) and a run length (compressor to evaporator) of approximately 20 ft. (6.10 m). The suction line had approximately the same run line length and an outside diameter of 0.875 in. (2.22 cm). The refrigeration circuit was powered by a Bitzer Model 2Q-4.2Y compressor.

A sensing bulb was attached to the suction line about two feet (0.61 m) from the compressor and was coupled to the multifunction device as described above with respect to FIG. 1. The thermostatic expansion valve component of the multifunctional device was set at 15° F. (8.3° C.) superheat.

The circuit was charged with AZ-50 refrigerant and the operating temperature range in the freezer was from −15° F. (−26.1° C.) to −20° F. (−28.9° C.)

Medium Temperature System

The refrigeration circuit of an eleven door Russell walk-in cooler was equipped with a multifunctional device as described herein (which included a Sporlan Q-body thermostatic expansion valve).

This refrigeration circuit included an evaporator feed line having an outside tube diameter of 0.5 in. (1.27 cm) and a run length (compressor to evaporator) of approximately 20 ft. (6.10 m). The suction line had approximately the same run line length and an outside diameter of 0.625 in. (1.59 cm). The system was powered by a Bitzer Model 2V-3.2Y compressor and used R-404A refrigerant.

A sensing bulb was attached to the suction line about two feet (0.61 m) from the compressor and was coupled to the multifunction device as described above with respect to FIG. 1. The thermostatic expansion valve component of the multifunctional device was set at 20° F. (11.1° C.) superheat. The operating temperature range in the cooler was from 32° F. (°C.) to 36° F. (2.2° C.)

Field Test Evaluation

An independent testing/certifying agency initially inspected the freezer and noted that it had a box temperature of 18° F. (−7.7° C.). The unit was then manually cycled through a hot gas defrost cycle that took approximately 45 minutes to bring the suction temperature to 55° F. (12.8° C.), thereby confirming a totally frost-free evaporator coil. The freezer was then manually put back into a normal refrigeration mode and the pins removed from the defrost clock to insure that it would not go through a defrost cycle. A visual check of the freezer evaporator coil showed a clear and frost-free coil.

At the same time, this independent testing/certifying agency made a visual check of the walk-in cooler and noted that it was maintaining a 31° F. (−0.6° C.) box temperature. The coil was observed to be free of frost and all pins were pulled from the defrost clock to ensure that it would not go through a defrost cycle.

Thirty-five days after the above activities, a further inspection was made and it was noted that the freezer was still at −18° F. (−7.8° C.). A visual check of the freezer evaporator coils showed that they were essentially the same as they had been thirty-five days earlier. The roof top condenser for the freezer showed no evidence of excessive icing. While not requiring defrost, the freezer unit was manually cycled through a hot gas defrost operation which took less than one hour to bring the suction temperature to 55° F. (12.8° C.) at termination of defrost. The freezer was then restarted and the temperature therein reduced to its normal operating level. A visual inspection of the cooler unit confirmed that it had maintained its 31° F. (−0.6° C.).

Documented conclusions reached by the independent testing/certification agency were that the freezer maintained a box temperature of approximately −18° F. (−27.8° C.) without requiring a defrost cycle and that the coil thereof was not affected by frost or ice build-up. An inspection of products contained in the freezer correspondingly showed no evidence of moisture or frost build-up thereon. With respect to the walk-in cooler, this agency likewise concluded that after the thirty-five day period the unit was holding a box temperature of 31° F. (−0.6° C.) and that there was no frost build-up on the coil without any defrost cycle having occurred during that thirty-five day period. Subsequent inspections showed that these same results were obtained with the XDX walk-in cooler over a 200 day period and with the XDX freezer over a sixty-five day period.

EXAMPLE VII

In the foregoing Examples, in each of the vapor compression systems of the present invention (the XDX systems), the multifunctional devices (including the expansion valve) were located in close proximity to the compressor and condenser units. While it is generally preferable, particularly in commercial refrigeration systems, to locate the compressor, expansion device and condenser remotely from the refrigeration or freezer compartment associated therewith, a test was conducted wherein multifunctional devices were positioned at locations relatively remote from the condenser and evaporator.

In this Example, an eleven door walk-in cooler (approximately 30 ft.×8 ft.) was equipped with two Warren Scherer Model SPA3-139 evaporators. A compressorized unit (which included a Copeland Model ZF13-K4E scroll compressor, a condenser and receiver) was connected by a liquid line having a run length of approximately 30 ft. to a tandem pair of multifunctional devices of the type described herein (each of which included a Sporlan Q-body thermostatic expansion valve). Each of these multifunctional devices was connected to a single evaporator by an evaporator feed line. In the one case, the evaporator feed line had an outside diameter of ⅜ in. (0.95 cm) of approximately 20 ft. (6.10 m) in length and, in the other case, by the evaporator feed line had an outside diameter of 0.5 in. (1.27 cm) and a run length of approximately 30 ft. (9.14 m).

A common suction line having an outside diameter of 0.625 in. (1.59 cm) connected each of the evaporators to the compressor. The cooler had an operating temperature range of 32° F. (°C.) to 36° F. (2.2° C.). The refrigeration circuit was charged with R-22 refrigerant. A sensing bulb attached to the suction line about 30 feet (9.14 m) from the compressor was operatively connected to each of the multifunctional devices, each of which was equipped with a Sporlan Q-body thermostatic expansion valve which was set at 30° F. (16.7° C.) superheat.

Continuous operation of this medium temperature system over a period of more than 65 days has demonstrated that the coils in each of the evaporators were characterized by the aforementioned improved evaporator coil heat transfer efficiency, absence of build-up of ice or frost on the surfaces thereof and other advantages of the present invention. Accordingly, this Example demonstrates that the benefits of the present invention can, under appropriate conditions be obtained with a multifunctional device that is not in the close proximity to the compressorized unit and, it further illustrates the use of more than one multifunctional device with a single compressorized unit.

As described above, volumetric and mass velocities at the evaporator inlet of refrigeration/freezer systems embodying the present invention will be greater than with conventional refrigeration/freezer systems employing the same refrigerant and operating with the same coiling load and evaporator temperature conditions. Based on data collected to date, it is believed that refrigerant evaporator inlet volumetric velocities for XDX are at least approximately 10% and generally from 10% to 25% or more greater than refrigerant volumetric velocities employing like refrigerants and operating under like cooling load and evaporator temperature conditions. Correspondingly, based on data collected to date, it is believed that refrigerant evaporator inlet mass velocities for XDX are at least approximately 5% and generally from 5% to 20% or more greater than refrigerant evaporator inlet mass velocities employing the same refrigerant and operating under like cooling load and evaporating temperature conditions.

The linear flow rates of liquid/vapor refrigerant mixture in XDX between the compressorized unit and the evaporation will likewise be greater than that of the liquid refrigerant in a conventional system which typically run from 150 to 350 feet per minute. Based on testing done to date, it is believed that linear flow rates in the evaporator feed line between the compressorized unit and the evaporator are generally at least 400 feet per minute and generally are from approximately 400 to 750 feet per minute or more.

Additionally, in order to achieve full utilization of the entire coil in the evaporator, it is preferred that the refrigerant discharge therefrom (i.e. at the evaporator outlet) include a small liquid portion (e.g. approximately, ½% or less) of the total vapor/liquid mass.

Figure 22:
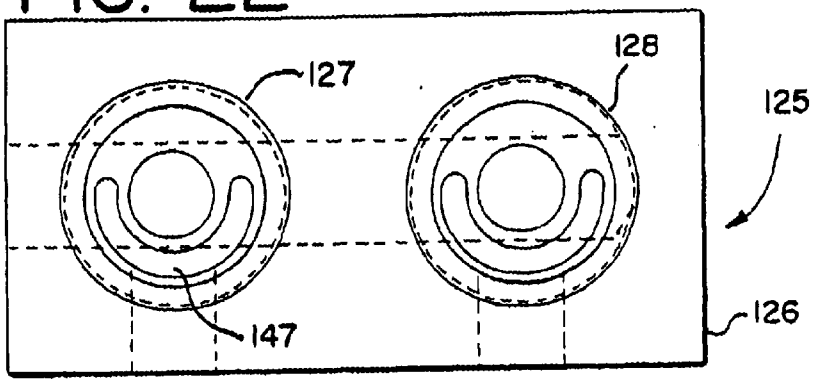
FIG. 22 is a side elevational view of the valve body of the multifunctional valve shown in FIG. 21.
Figure 21:
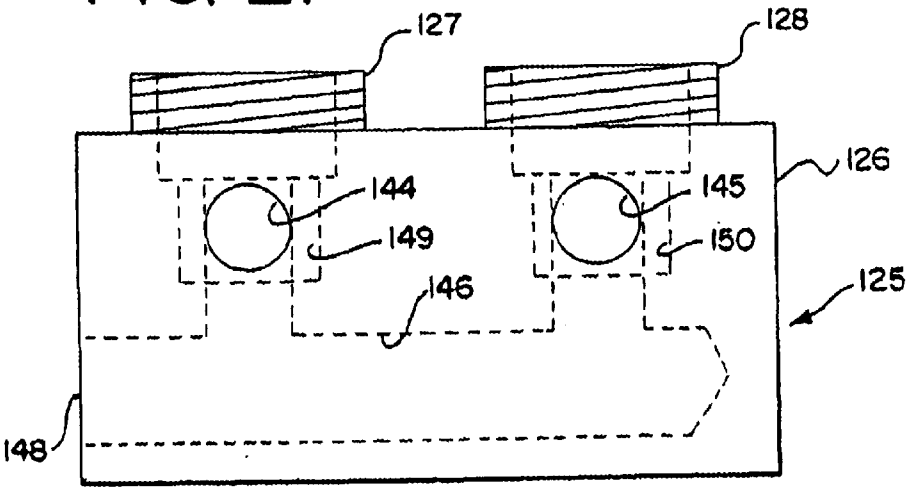
FIG. 21 is a plan view, partially in section, of valve body on a multifunctional valve or device in accordance with a further embodiment of the present invention.
Figure 23:
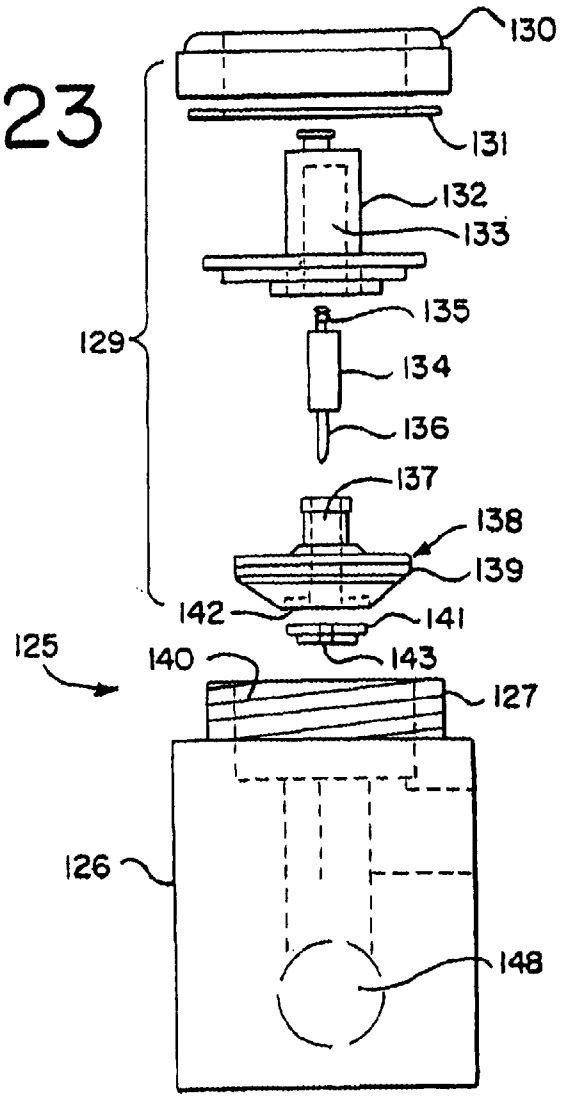
FIG. 23 is an exploded view, partially in section, of the multifunctional valve or device shown in FIGS. 21 and 22.

Another embodiment of a multifunctional valve or device 125 is shown in FIGS. 21–23 and is generally designated by the reference numeral 125. This embodiment is functionally similar to that described in FIGS. 2–4 which was generally designated by the reference numeral 18. As shown, this embodiment includes a main body or housing 126 which preferably is constructed as a single one-piece structure having a pair of threaded bosses 127, 128 that receive a pair of gating valves and collar assemblies, one of which being shown in FIG. 23 and designated by the reference numeral 129. This assembly includes a threaded collar 130, gasket 131 and solenoid-actuated gating valve receiving member 132 having a central bore 133, that receives a reciprocally movable valve pin 134 that includes a spring 135 and needle valve element 136 which is received with a bore 137 of a valve seat member 138 having a resilient seal 139 that is sized to be sealingly received in well 140 of the housing 126. A valve seat member 141 is snuggly received in a recess 142 of valve seat member 138. Valve seat member 141 includes a bore 143 that cooperates with needle valve element 136 to regulate the flow of refrigerant therethrough.

A first inlet 144 (corresponding to first inlet 24 in the previously described embodiment) receives liquid feed refrigerant from an expansion device (e.g. thermostatic expansion valve) and a second inlet 145 (corresponding to second inlet 26 of the previously described embodiment) receives hot gas from the compressor during a defrost cycle. The valve body 126 includes a common chamber 146 (corresponding to chamber 40 in the previously described embodiment). The thermostatic expansion valve (not shown) receives refrigerant from the condenser which passes through inlet 144 into a semicircular well 147 which, when gating valve 129 is open, then passes into common chamber 146 and exits from the device through outlet 148 (corresponding to outlet 41 in the previously described embodiment).

A best shown in FIG. 21 the valve body 126 includes a first passageway 149 (corresponding to first passageway 38 of the previously described embodiment) which communicates first inlet 144 with common chamber 146. In like fashion, a second passageway 150 (corresponding to second passageway 48 of the previously described embodiment) communicates second inlet 145 with common chamber 146.

Insofar as operation of the multifunctional valve or device 125 is concerned, reference is made to the previously described embodiment since the components thereof function in the same way during the refrigeration and defrost cycles.

It will be apparent to those skilled in this art that the present invention and the various aspects thereof can be embodied in other forms of vapor compression refrigeration systems and that modifications and variations therefrom can be made without departing from the spirit and scope of this invention. Accordingly, this invention is to be limited only by the scope of the appended claims.

I claim:

1. A method of operating a vapor compression refrigeration system wherein an evaporator removes heat from a medium which is circulated through said evaporator in heat exchange relation with an evaporator coil in said evaporator, said coil including an inlet which is in flow communication with an expansion device and an outlet which is in flow communication with a compressor, the method comprising:

compressing a refrigerant fluid in said compressor;

condensing said refrigerant fluid in a condenser to form a condensed refrigerant fluid;

expanding said condensed refrigerant fluid in said expansion device to form an expanded refrigerant fluid, wherein said expanded refrigerant fluid is in a liquid form or substantially in said liquid form with a small vapor fraction;

supplying said expanded refrigerant to an evaporator feed line connecting said expansion device to said evaporator coil inlet;

converting a significant amount of said liquid form to a liquid and vapor mixture within said evaporator feed line, wherein the diameter and length of said evaporator feed line facilitates said conversion;

supplying said mixture of refrigerant vapor and liquid to said evaporator coil inlet, and converting substantially all of said liquid to vapor as said mixture passes through said evaporator coil;

wherein said evaporating coil is sized to provide refrigerant comprising liquid and vapor at said outlet of said evaporator coil during the portion of each refrigeration cycle when said expansion device is supplying said mixture of said refrigerant vapor and liquid to said evaporating coil inlet.

2. The method of claim 1 wherein approximately 2% of the mass of said refrigerant is a liquid at said outlet of said evaporator coil during the portion of each refrigeration cycle when said expansion device is actively supplying said mixture of said refrigerant vapor and liquid to said evaporating coil inlet.

3. The method of claim 1 wherein the diameter and length of said evaporator feed line are such that, when operating at the same cooling load, the volumetric velocity of said refrigerant vapor and liquid mixture measured at said evaporator coil inlet is at least 10% greater than the volumetric velocity of refrigerant measured at said evaporator coil inlet when said significant amount of said liquid form is not converted to a liquid and vapor mixture within said evaporator feed line; wherein said volumetric velocity of refrigerant is measured by a vapor reading meter.

4. The method of claim 3 wherein the volumetric velocity of said refrigerant vapor and liquid mixture measured at said evaporator coil inlet is from approximately 10% to 25% greater than the volumetric velocity of the refrigerant measured at the evaporator inlet when said significant amount of said liquid form is not converted to a liquid and vapor mixture within said evaporator feed line.

5. The method of claim 3 wherein the volumetric velocity of said refrigerant vapor and liquid mixture measured at said evaporator coil inlet is approximately 18% greater than the volumetric velocity of the refrigerant measured at the evaporator inlet when said significant amount of said liquid form is not converted to a liquid and vapor mixture within said evaporator feed line.

6. The method of claim 1 wherein the diameter and length of said evaporator feed line are such that, when operating at the same cooling load, the mass flow rate of said refrigerant vapor and liquid mixture measured at said evaporator coil inlet is at least 5% greater than the mass flow rate of refrigerant measured at said evaporator coil inlet of said vapor compression refrigeration system when said significant amount of said liquid form is not converted to a liquid and vapor mixture within said evaporator feed line; wherein said mass flow rate of refrigerant is measured by a vapor reading meter.

7. The method of claim 6 wherein the mass flow rate of said refrigerant vapor and liquid mixture measured at said evaporator coil inlet is from approximately 5 to 20% greater than the mass flow rate of refrigerant measured at the evaporator inlet when said significant amount of said liquid form is not converted to a liquid and vapor mixture within said evaporator feed line.

8. The method of claim 6 wherein the mass flow rate of said refrigerant vapor and liquid mixture measured at said evaporator coil inlet is approximately 12% greater than the mass flow rate of the refrigerant measured at the evaporator inlet of when said significant amount of said liquid form is not converted to a liquid and vapor mixture within said evaporator feed line.

9. The method of claim 1, wherein, when operating at the same cooling load, buildup of frost on said evaporator coil is reduced such that said vapor compression refrigeration system can be operated without requiring a defrosting cycle over an increased number of refrigeration cycles as compared to said vapor compression refrigeration system when said significant amount of said liquid form is not converted to a liquid and vapor mixture within said evaporator feed line.

10. The method of claim 1, wherein said medium is air, said medium is withdrawn from a refrigerated compartment, circulated through the evaporator in heat exchange relation with the evaporator coil, and returned to the refrigerated compartment, and the differential temperature between said coil and said medium adjacent at least a portion of said coil, during at least a portion of a refrigeration cycle, is sufficient to substantially maintain a relative humidity of said medium.

11. The method of claim 10 wherein said air medium is circulated in counter-current relation to the flow of refrigerant vapor and liquid particles in said evaporating coil wherein the temperature of the air being supplied to said evaporator from said refrigerated compartment is equal to or lower than the temperature of the evaporating coil inlet during at least the portion of a refrigeration cycle.

12. The method of claim 1 wherein said mixture of refrigerant vapor and liquid is supplied to the evaporator coil inlet at a linear velocity of at least 400 feet per minute.

13. The method of claim 12 wherein said linear velocity is at least from 400 to 750 feet per minute.

14. A vapor compression refrigeration system comprising:

a compressor for increasing the pressure and temperature of a refrigerant vapor, said compressor having an inlet and an outlet;

a condenser having an inlet in flow communication with the outlet of said compressor for liquefying pressurized refrigerant vapor received from said compressor;

an expansion device having a first inlet which, during a cooling mode of operation of said refrigeration system, is in flow communication with an outlet of said condenser for receiving liquid refrigerant from said condenser and expanding the same to form an expanded refrigerant fluid, wherein said expanded refrigerant fluid is in a liquid form or substantially in said liquid form with a small vapor fraction;

an evaporator including an evaporating coil having an inlet and an outlet, said evaporating coil being in heat exchange relation with an air medium along substantially the entire length of said coil;

an evaporator feed line providing flow communication of said expansion device with said evaporating coil inlet;

a suction line providing flow communication of said evaporating coil outlet with said compressor inlet;

said expansion device and said evaporator feed line, during a cooling mode of operation of said vapor compression refrigeration system, being sized to convert a significant amount of said liquid form to a liquid and vapor mixture within said evaporator feed line and to provide said evaporating coil inlet with a refrigerant liquid and vapor mixture that includes a substantial vapor portion, said evaporating coil being sized to provide refrigerant comprising liquid and vapor at said outlet of said evaporator coil during the portion of each refrigeration cycle when said expansion device is supplying said mixture of said refrigerant vapor and liquid to said evaporating coil inlet.

15. The vapor compression refrigeration system of claim 14 wherein said expansion device is a multi-functional valve which includes a second inlet, said second inlet being in flow communication with the outlet of said compressor when said refrigeration system is in a defrost mode of operation during which the pressurized refrigerant vapor which is discharged from said compressor outlet is supplied to said multi-functional valve, through said evaporator feed line and into the inlet of said evaporator coil.

16. The vapor compression refrigeration system of claim 15 wherein said multi-functional valve includes a second inlet, a first passageway coupled to the first inlet, said first passageway being gated by a first valve, a second passageway coupled to the second inlet, the second passageway being gated by a second valve, and a metering valve positioned in the first passageway which is activated by the sensor in said suction line.

17. The vapor compression refrigeration system of claim 16 wherein each of said first and second valves is a solenoid valve.

18. The vapor compression refrigeration system of claim 14 wherein said sensor is temperature activated.

19. The vapor compression refrigeration system of claim 14, further comprising a unit enclosure and a refrigeration case, wherein the compressor, evaporator and expansion device are located within the unit enclosure and wherein the evaporator is located within the refrigeration case.

20. The vapor compression refrigeration system of claim 14 wherein said expansion device comprises a thermostatic expansion valve.

21. The vapor compression refrigeration system of claim 14 wherein said expansion device comprises an automatic expansion valve.

22. The vapor compression refrigeration system of claim 14 wherein said expansion device comprises a capillary tube.

23. The vapor compression refrigeration system of claim 14 wherein said expansion device is closer to the outlet of said condenser than to the inlet of said evaporating coil.

24. The vapor compression refrigeration system of claim 14 wherein said expansion device is adjacent the outlet of said condenser.

25. A vapor compression refrigeration system comprising:

a compressor for increasing the pressure and temperature of a refrigerant vapor, said compressor having an inlet and an outlet;

a condenser having an inlet in flow communication with the outlet of said compressor for liquefying pressurized refrigerant vapor received from said compressor;

an expansion device which, during a cooling mode of operation of said refrigeration system, is in flow communication with an outlet of said condenser for receiving liquid refrigerant from said condenser and expanding the same, said expansion device including a thermostatic expansion valve having an inlet and an outlet, the outlet of said thermostatic expansion valve being in series flow communication with an inlet to a multifunctional valve which includes an expansion chamber whereby liquid refrigerant supplied to said expansion device undergoes a two-stage expansion;

an evaporator including an evaporating coil having an inlet and an outlet, said evaporating coil being in a heat exchange relation with an air medium along substantially the entire length of said coil;

an evaporator feed line providing flow communication of said expansion device with said evaporating coil inlet;

a suction line providing flow communication of said evaporating coil outlet with said compressor inlet;

said expansion device and said evaporator feed line, during a cooling mode of operation of said vapor compression refrigeration system, being sized to convert a significant amount of said liquid form to a liquid and vapor mixture within said evaporator feed line and to provide said evaporating coil inlet with a refrigerant liquid and vapor mixture that includes a substantial vapor portion, said evaporating coil being sized to provide refrigerant comprising liquid and vapor at said outlet of said evaporator coil during the portion of each refrigeration cycle when said expansion device is supplying said mixture of said refrigerant vapor and liquid to said evaporating coil inlet.

26. A method of operating a vapor compression refrigeration system, comprising:

expanding a condensed refrigerant fluid in an expansion device to form an expanded refrigerant fluid, wherein said expanded refrigerant fluid is in a liquid form or substantially in said liquid form with a small vapor fraction;

supplying said expanded refrigerant to an evaporator feed line connecting said expansion device to an evaporator coil inlet;

converting a significant amount of said liquid form to a liquid portion and a vapor portion within said evaporator feed line, wherein the diameter and length of said evaporator feed line facilitates said conversion;

supplying said liquid portion and vapor portion to said evaporator coil inlet;

converting a part of the liquid portion to vapor as the refrigerant passes through the evaporator coil, wherein said evaporating coil is sized to provide refrigerant comprising liquid and vapor at said outlet of said evaporator coil during the portion of each refrigeration cycle when said expansion device is supplying said mixture of said refrigerant vapor and liquid to said evaporating coil inlet; and discharging said refrigerant liquid and vapor mixture from the evaporator coil.

27. The method of claim 26, wherein approximately 2% of the mass of said refrigerant comprises liquid during said discharging.

28. The method of claim 26 wherein air is circulated in counter-current relation to the flow of refrigerant in said evaporating coil, and the temperature of the air prior to contacting the evaporator coil is equal to or lower than the temperature at an inlet of the evaporating coil.

29. The method of claim 26 wherein said refrigerant is supplied to the evaporator coil at a linear velocity is at least 400 feet per minute.

30. The method of claim 29, wherein said linear velocity is at least from 400 to 750 feet per minute.

* * * * *